US005256524A

United States Patent [19]

Yoshimoto et al.

[11] Patent Number: 5,256,524

[45] Date of Patent: Oct. 26, 1993

[54] PROCESSING METHOD FOR SILVER HALIDE COLOR PHOTOGRAPHIC LIGHT-SENSITIVE MATERIAL

[75] Inventors: Hiroshi Yoshimoto; Shigeharu Koboshi; Masao Ishikawa; Mayumi Emoto, all of Hino, Japan

[73] Assignee: Konica Corporation, Tokyo, Japan

[21] Appl. No.: 753,873

[22] Filed: Sep. 3, 1991

[30] Foreign Application Priority Data

| | | | |
|---|---|---|---|
| Sep. 5, 1990 | [JP] | Japan | 3-234776 |
| Sep. 5, 1990 | [JP] | Japan | 3-234780 |
| Sep. 7, 1990 | [JP] | Japan | 3-238025 |
| Oct. 24, 1990 | [JP] | Japan | 3-286753 |
| Oct. 24, 1990 | [JP] | Japan | 3-286754 |
| Nov. 9, 1990 | [JP] | Japan | 3-302784 |
| Nov. 22, 1990 | [JP] | Japan | 3-318839 |

[51] Int. Cl.[5] ..... G03C 7/40

[52] U.S. Cl. ..... 430/372; 430/398; 430/400; 430/428; 430/455; 430/551

[58] Field of Search ..... 430/372, 428, 398, 393, 430/455, 551, 600, 400

[56] References Cited

U.S. PATENT DOCUMENTS 5,110,716 5/1992 Kuse et al. ..... 430/428

*Primary Examiner*—Hoa Van Le

*Attorney, Agent, or Firm*—Jordan B. Bierman

[57] ABSTRACT

Disclosed is a processing method for silver halide color photographic light-sensitive material in which a silver halide color photographic light-sensitive material is processed with a processing solution capable of fixation and then a part or all of the overflow from stabilizer is allowed to enter in the processing solution capable of fixing wherein said silver halide color photographic light-sensitive material contains a coupler represented by Formula 2eq-1 and said stabilizer contains substantially no formaldehyde but contains a compound represented by Formula I or Formula II:

Formula 2eq-1

$$R_1-O-(R_2-O)_m-X_1$$

(Formula I)

Formula II

The total amount of silver coated in said silver halide color photographic light-sensitive material is not less than 3 g and not more than 10 g per $m^2$ of light-sensitive material;

said silver halide color photographic light-sensitive material contains a compound represented by the following formulae B-1 through B-3, Formula B-1

Formula B-2

Formula B-3 the above constituents are defined in the specification. The processing method for silver halide color photographic light-sensitive material according to this invention offers good dye image preservability and improved staining in the unexposed portion and which permits waste liquid reduction and is hence excellent from the socio-environment viewpoint.

3 Claims, No Drawings

PROCESSING METHOD FOR SILVER HALIDE COLOR PHOTOGRAPHIC LIGHT-SENSITIVE MATERIAL

FIELD OF THE INVENTION

The present invention relates to a processing method for silver halide color photographic light sensitive material, more specifically to a processing method for silver halide color photographic light-sensitive material which offers good dye image preservability and improved staining in the unexposed portion and which permits waste liquid reduction and is hence excellent from the socio-environmental viewpoint.

BACKGROUND OF THE INVENTION

Silver halide photographic light-sensitive materials are typically subjected to imagewise exposure, after which they are processed in color development, bleaching, fixation or bleach-fixation, washing, stabilizing and other processes. It is a known fact that thiosulfate, a compound which forms a water-soluble complex salt upon reaction with silver halide, other compounds which form water-soluble complex salts of silver, and sulfite, metabisulfite and other preservatives, all in contact with the light-sensitive material, enter in the washing process which follows the process using a processing solution capable of fixation such as a fixer or bleach-fixer and adversely affect the image preservability in the case of small amounts of washing water. It is therefore a common practice to wash down the salts from the photographic material with a large amount of water after processing with the processing bath capable of fixation to overcome this drawback.

In recent years, however, there have been increasing demands for a process which uses a reduced amount of washing water and which takes a measure against environmental pollution for economic reasons such as a shortage of water resources and rises in sewage service fee and fuel, light expenses and for a reason of environmental concern.

Means of meeting these requirements include the method in which water is flown in countercurrent in a plurality of chambers of washing tank, described in West German Patent No. 2,920,222, S. R. Goldwasser, "Water Flow Rate in Immersion-washing of Motion-picture Film", SMPTE. vol. 64, 248 253, May (1955) and other publications.

Also known is the processing method in which a preliminary washing tank is provided immediately after the fixing bath to reduce the entrance of pollutants in contact with the light-sensitive material into the washing process and reduce the amount of washing water.

However, none of these methods fully avoids the use of washing water. With the recent trends toward shortage of water resources and rise in washing cost due to increased price of crude oil etc., these processing methods are of great concern.

The present applicants proposed a processing method wherein development is followed immediately by stabilization without washing in Japanese Patent Publication Open to Public Inspection (hereinafter referred to as Japanese Patent O.P.I. Publication) Nos. 14834/1983, 34448/1983, 132146/1982 and 18631/1983 and other publications to offer a solution to the problems described above. However, even this method involves various drawbacks. For example, in conventional processing methods, the previous bath component transferred in adherence to light-sensitive material has been diluted to high extent, since a large amount of water is used for washing, which waste liquid can be discharged as such to rivers, sewers, etc. On the other hand, the stabilizing process described above results in much accumulation of the previous bath component in the stabilizer, which waste liquid cannot be discharged as such to rivers or sewers because it is banned by legal regulations on environmental pollution. This necessitates expensive commission of waste liquid recovery to dedicated companies. Thus, huge expense is required to dispose the waste liquid, though the washing water cost become zero.

A method of solving this problem is described by the present applicants in Japanese Patent O.P.I. Publication Nos. 235133/1985, 212935/1988 and other publications. This method is characterized in that the overflow from stabilizing bath is allowed to enter in the processing bath capable of fixation, i.e., the previous bath.

However, even this method has some drawbacks; when the overflow from stabilizer is allowed to enter in the previous bath capable of fixation, the preservative sulfite is consumed and sulfide precipitation occurs therein because formaldehyde is usually contained in the stabilizer for color negative films for the purpose of improving the image stability by closing the active point of 4-equivalent coupler. As a means of solving this problem, there is a method using a stabilizer containing substantially no formaldehyde. Although this method avoids sulfide precipitation, a problem of stain in the unexposed portion arises in relation to the dye image stability in color negative films containing a 4-equivalent magenta coupler.

To solve this problem, methods using a 2-equivalent coupler, described in Japanese Patent O.P.I. Publication Nos. 54261/1987, 19660/1987 and 298344/1988 have been proposed. However, these processing methods for 2-equivalent coupler, wherein the overflow from the stabilizing bath which follows the processing bath capable of fixation is allowed to enter in the processing bath capable of fixation as the previous bath, were found to pose a problem of easy occurrence of staining in the unexposed portion and has a drawback of easy occurrence of reticulation. This tendency poses a major problem when the processing solution capable of fixation is replenished with a small amount of replenisher.

SUMMARY OF THE INVENTION

It is an object of the present invention to provide a processing method for silver halide color photographic light sensitive material which contains substantially no formaldehyde and which permits significant reduction in the amount of waste liquid and is hence excellent from the socioenvironmental viewpoint.

It is another object of the invention to provide a processing method for silver halide color photographic light-sensitive material which offers improvements in the prevention of staining in the unexposed portion and reticulation.

It is still another object of the invention to provide a processing method for silver halide color photographic light-sensitive material which is excellent in the storage stability of processing solution capable of fixation and which permits long-term stable processing.

The other objects will become obvious through the description which follows.

The processing method for silver halide color photographic light-sensitive material of the present invention, in which a silver halide color photographic light-sensitive material is processed with a processing solution capable of fixation whereafter a part or all of the overflow from stabilizer is allowed to enter in the processing solution capable of fixation, is characterized in that said silver halide color photographic light-sensitive material contains a coupler represented by Formula 2eq-1 and said stabilizer contains substantially no formaldehyde but contains a compound represented by Formula I or II.

Formula 2eq-1

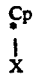

wherein Cp represents a coupler residue; * represents a coupler coupling site; X represents a group which splits off upon dye formation by coupling with the oxidation product of an aromatic primary amine based color developing agent.

Formula (I)

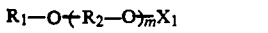

wherein $R_1$ represents a monovalent organic group; $R_2$ represents an ethylene group, trimethylene group or propylene group; m represents an integer of 4 to 50. $X_1$ represents a hydrogen atom, $-SO_3M$ or $-PO_3M_2$, wherein M represents a hydrogen atom, alkali metal or ammonium.

Formula II

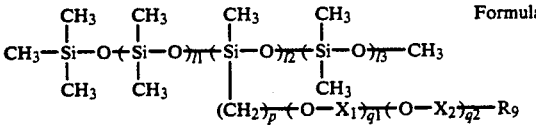

wherein $R_9$ represents a hydrogen atom, hydroxyl group, lower alkyl group, alkoxy group,

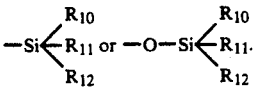

$R_{10}$, $R_{11}$ and $R_{12}$, whether identical or not, independently represent a hydrogen atom or lower alkyl group, which lower alkyl group preferably has 1 to 4 carbon atoms, such as a methyl group, ethyl group or propyl group; $l_1$ through $l_3$ independently represent an integer of 0 to 30; p, $q_1$ and $q_2$ independently represent an integer of 0 to 30.; $X_1$ and X2 independently represent $-CH_2CH_2-$, $-CH_2CH_2CH_2-$,

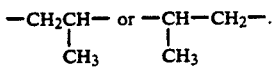

A preferred mode of embodiment of the present invention is that the total amount of silver coated in the silver halide color photographic light-sensitive material is not less than 2 g per $m^2$ of light-sensitive material and the silver halide color photographic light-sensitive material contains a compound represented by the following formulae B-1 through B-3.

Formula B-1

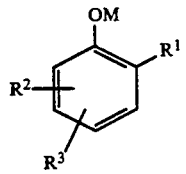

wherein $R_1$ represents an alkyl group, cycloalkyl group, aryl group, hydroxyl group, alkoxycarbonyl group, amino group, carboxylic acid group (including its salt) or sulfonic acid group (including its salt). $R^2$ and $R^3$ independently represent a hydrogen atom, halogen atom, amino group, nitro group, hydroxyl group, alkoxycarbonyl group, carboxylic acid group (including its salt) or sulfonic acid group (including its salt). M represents a hydrogen atom, alkali metal or ammonium group.

Formula B-2

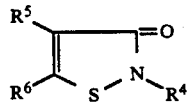

Formula B-3

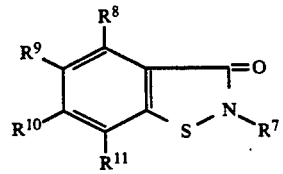

wherein $R^4$ represents a halogen atom, alkyl group, aryl group, halogenated alkyl group, $-R^{12}-OR^{13}$, $-CONHR^{14}$ ($R^{12}$ represents an alkylene group; $R^{13}$ and $R^{14}$ independently represent a hydrogen atom, alkyl group or arylalkyl group) or arylalkyl group; $R^5$ and $R^6$ independently represent a hydrogen atom, halogen atom, halogenated alkyl group or alkyl group; $R^7$ represents a hydrogen atom, halogen atom, alkyl group, aryl group, halogenated alkyl group, arylalkyl group, $-R^{15}-R^{16}$ or $-CONHR^{17}$ ($R^{15}$ represents an alkylene group; $R^{16}$ and $R^{17}$ independently represent a hydrogen atom or alkyl group); $R^8$, $R^9$, $R^{10}$ and $R^{11}$ independently represent a hydrogen atom, halogen atom, hydroxyl group, alkyl group, amino group or nitro group.

Preferable processing procedures for the processing method using the processing solution according to the present invention are as follows.

(1) Color development→bleach-fixation→stabilization
(2) Color development→bleaching→bleach-fixation→stabilization
(3) Color development→bleaching→bleach-fixation→stabilization
(4) Color development→bleach-fixation→fixation→stabilization
(5) Color development→bleach-fixation→bleach-fixation→stabilization
(6) Color development→bleaching→bleach-fixation→fixation→stabilization Preference is given to the procedures (1), (2) and (3). The processing solution capable of fixation according to the present invention means both a bleach-fixer and fixer.

The compound represented by Formula I is exemplified by the following compounds.

$C_{12}H_{25}O(C_2H_4O)_{10}H$ I-1

$C_8H_{17}O(C_3H_6O)_{15}H$ I-2

$C_9H_{19}O(C_2H_4O)_{14}SO_3Na$ I-3

$C_{10}H_{21}-O(C_2H_4O)_{15}-PO_3Na_2$ I-4

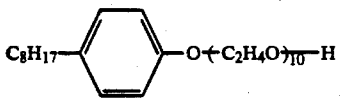

I-5

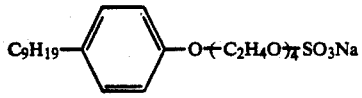

I-6

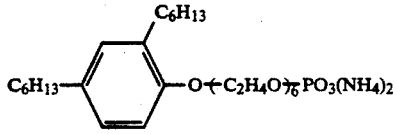

I-7

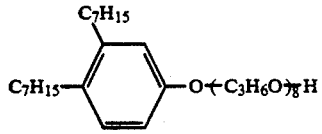

I-8

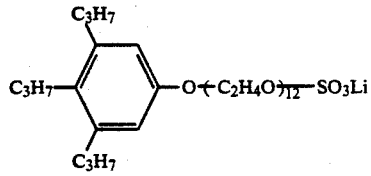

I-9

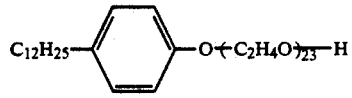

I-10

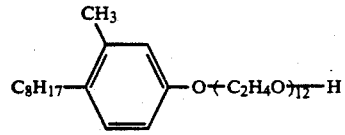

I-11

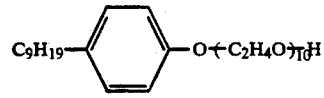

I-12

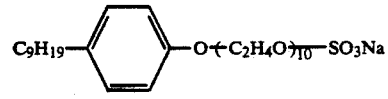

I-13

$C_{13}H_{27}O(C_2H_4O)_{10}H$ I-14

$C_{15}H_{31}O(C_2H_4O)_{12}H$ I-15

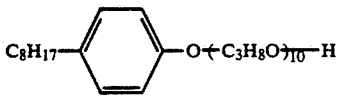

I-16

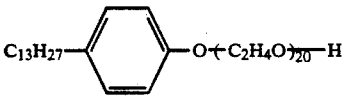

I-17

-continued

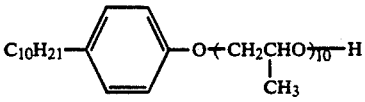

I-18

$C_{10}H_{21}O(C_2H_4O)_{10}H$ I-19

These compounds represented by Formula I may be used in combination. The total amount of their addition is 0.1 to 40 g, preferably 0.3 to 20 g per liter of stabilizer for the invention.

The compound represented by Formula II is exemplified by the following compounds.

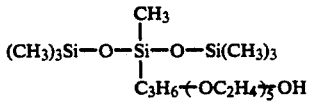

II-1

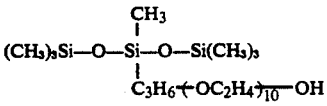

II-2

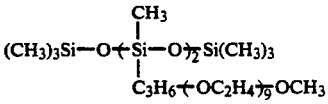

II-3

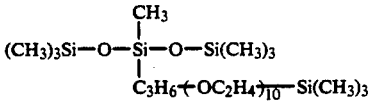

II-4

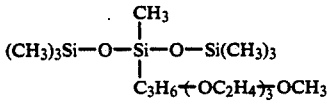

II-5

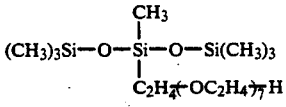

II-6

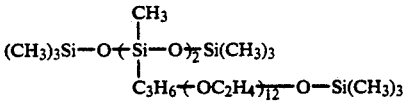

II-7

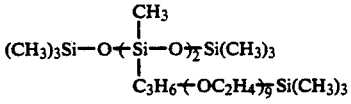

II-8

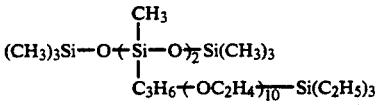

II-9

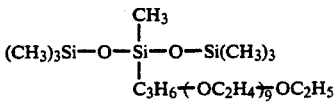

II-10

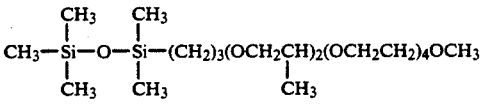

II-11

-continued

II-12

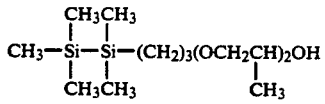

II-13

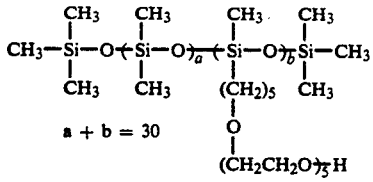

a + b = 30

II-14

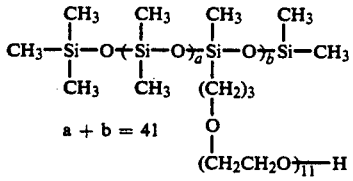

a + b = 41

II-15

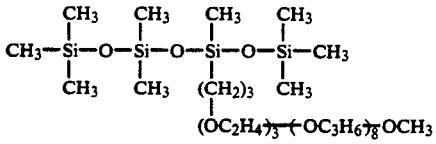

II-16

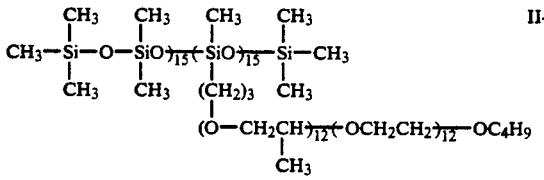

II-17

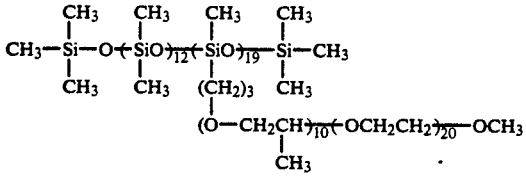

II-18

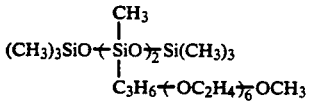

These water-soluble organic siloxane compounds having a polyoxyalkylane group, represented by Formula II, may be used in combination. When used in a total amount of 0.01 to 20 g per liter of stabilizer, they have a good effect particularly on the prevention of precipitation and flaws without involving much deposition on the light-sensitive material surface.

The water-soluble organic siloxane compound for the present invention is an ordinary water-soluble organic siloxane compound as described in Japanese Patent O.P.I Publication Nos. 18333/1972 and 62128/1974, Japanese Patent Examined Publication Nos. 51172/1980 and 37538/1976, U.S. Pat. No. 3,545,970 and other publications.

These water-soluble organic siloxane compounds are commercially available from UCC (Union Carbide Company), Shin-Etsu Chemical Co., Ltd. and other suppliers.

Although the stabilizer for the present invention may be supplied from a single bath, the number of baths may be increased within the range of from about 2 to 10 baths, whereby the desired effect of the invention is enhanced. Although the replenisher for the stabilizer may be supplied in several steps, it is preferable to supply the replenisher to a bath and allow the overflow therefrom (including the case where the bath solution passes through a tube below the liquid surface level which communicates the two baths) to enter in the previous bath. It is more preferable to use two or more stabilizing baths, supply the stabilizer replenisher to the final stabilizing bath, allow the overflow to sequentially enter in the previous bath and allow a part or all of the overflow from the stabilizing bath which follows the processing solution capable of fixation to enter in the processing solution capable of fixation, whereby the effect of the invention is enhanced. As the case may be, it is also acceptable to use two or more stabilizing baths and allow a part or all of the overflow from an intermediate stabilizing bath between the first and last stabilizing baths.

In the present invention, "to allow a part or all of the overflow from the stabilizer to enter in the processing solution capable of fixation" specifically includes the method in which the overflow is allowed to directly enter through piping, the method in which the overflow is once retained in a reservoir and then pumped or otherwise flown and the method in which the overflow is flown after being prepared as a replenisher for the processing solution capable of fixation in a mixing tank.

In the present invention, "to contain substantially no formaldehyde" means that the formaldehyde content is 0 to 0.2 g per liter of stabilizer. In the present invention, the amount of replenisher added to stabilizing bath is preferably not more than 800 ml per $m^2$ of light-sensitive material, with more preference given to the range from 100 to 620 ml, since excess reduction in the amount of replenisher results in dye fading, post-drying salt separation on the light-sensitive material surface and other problems.

More specific setting of the amount of replenisher varies depending on the tank configuration of stabilizing bath; the amount of replenisher can be set at lower levels as the number of tanks increase.

The pH of the stabilizing bath for the present invention is preferably 5.5 to 11.0, with more preference given to the range of from 7 to 10.5, more preferably 7.5 to 10 for enhancing the effect of the invention. Also, temperature is preferably 15° to 70° C., more preferably 20° to 55° C. The stabilizing time for the invention is preferably not longer than 120 seconds, more preferably 3 to 90 seconds, and still more preferably 6 to 60 seconds.

In the present invention, it is preferable to add a chelating agent having an iron ion chelate stability constant of over 8 to the stabilizer. Here, the chelate stability constant is the constant which is well known in L. G. Sillen and A. E. Martell, "Stability Constants of Metal Ion Complexes", The Chemical Society, London (1964), S. Chaberek and A. E. Martell in "Organic Sequestering Agents", Wiley (1959) and other publications.

Examples of chelating agents having an iron ion chelate stability constant of over 8 include organic carboxylic acid chelating agents, organic phosphoric acid chelating agents, inorganic phosphoric acid chelating agents and polyhydroxy compounds. The iron ion means the ferric ion ($Fe^{3+}$).

Examples of chelating agents having a ferric ion chelate stability constant of over 8 include ethylenediaminediorthohydroxyphenylacetic acid, diaminopropanetetraacetic acid, nitrilotriacetic acid, hydroxyethylenediaminetriacetic acid, dihydroxyethyl glycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, trans-cyclohexanediaminetetraacetic acid, glycol ether diaminetetraacetic acid, ethylenediaminetetrakismethylene-phosphonic acid, nitrilotrimethylenephosphonic acid, 1-hydroxyethylidene-1,1-diphosphonic acid, 1,1 -diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrophosphate, sodium tetrapolyphosphate and sodium hexametaphosphate, but these are not to be construed as limitative. Of these compounds, diethylenetriaminepentaacetic acid, nitrilotriacetic acid, nitrilotrimethylenephosphonic acid, 1-hydroxyethylidene-1,1-diphosphonic acid and others are more preferable, with most preference given to 1-hydroxyethylidene-1,1-diphosphonic acid.

The amount of the chelating agent is preferably 0.01 to 50 g, more preferably 0.05 to 20 g per liter of stabilizer, in which content range good results are obtained.

Ammonium compounds are preferably added to the stabilizer, which are supplied by ammonium salts of various inorganic compounds, including ammonium hydroxide, ammonium bromide, ammonium carbonate, ammonium chloride, ammonium hypophosphite, ammonium phosphate, ammonium phosphite, ammonium fluoride, acidic ammonium fluoride, ammonium fluoroborate, ammonium arsenate, ammonium hydrogen carbonate, ammonium hydrogen fluoride, ammonium hydrogen sulfate, ammonium sulfate, ammonium iodide, ammonium nitrate, ammonium pentaborate, ammonium acetate, ammonium adipate, ammonium laurin tricarboxylate, ammonium benzoate, ammonium carbamate, ammonium citrate, ammonium diethyldithiocarbamate, ammonium formate, ammonium hydrogen malate, ammonium hydrogen oxalate, ammonium phthalate, ammonium hydrogen tartrate, ammonium thiosulfate, ammonium sulfite, ammonium ethylenediaminetetraacetate, ferric ammonium ethylenediaminetetraacetate, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfanylate, ammonium tartrate, ammonium thioglycolate and 2,4,6-trinitrophenol ammonium.

These ammonium compounds may be used singly or in combination. The amount of ammonium compound added is preferably 0.001 to 1.0 mol, more preferably 0 002 to 2.0 mol per liter of stabilizer.

The stabilizer preferably contains a metal salt in combination with the chelating agent described above. Examples of such metal salts include salts of Ba, Ca, Ce, Co, In, La, Mn, Ni, Bi, Pb, Sn, Zn, Ti, Zr, Mg, Al and Sr, and it can be supplied as an inorganic salt such as halide, hydroxide, sulfate, carbonate, phosphate or acetate, or a water-soluble chelating agent.

The amount of its addition is preferably $1\times10^{-4}$ to $1\times10^{-1}$ mol, more preferably $4\times10^{-4}$ to $2\times10^{-2}$ mol per liter of stabilizer.

The stabilizer may contain an organic salt such as citrate, acetate, succinate, oxalate or benzoate, and a pH regulator such as malate, borate, hydrochloric acid or sulfate. These compounds may be used in any combination, as long as the amount of their addition is necessary to maintain the desired pH in the stabilizing bath and as long as it does not adversely affect the stability of color photographic images or the occurrence of precipitation during storage.

In the present invention, one or more fungicides can be added, whether singly or in combination, as long as the effect of the invention is not degraded.

In the processing method of the present invention, silver may be recovered from the stabilizer. Examples of methods which serve well for this purpose include the electrolytic method described in French Patent No. 2,299,667, the precipitation method described in Japanese Patent O.P.I. Publication No. 73037/1977 and German Patent No. 2,331,220, the ion exchange method described in Japanese Patent O.P.I. Publication No. 17114/1976 and German Patent No. 2,548,237 and the metal replacement method described in British Patent No. 1,353,805.

For silver recovery, it is particularly preferable to recover silver from the tank solution on an in-line basis using the electrolytic method or anion exchange resin method, since the rapid processing suitability improves, but silver may be recovered from the overflow waste liquid and recycled.

The stabilizer may be subjected to ion exchange treatment, electrodialytic treatment (Japanese Patent O.P.I. Publication No. 28949/1986), reverse osmotic treatment (Japanese Patent O.P.I. Publication Nos. 240153/1985 and 254151/1987) and other treatments. It is also preferable to use deionized water for the stabilizer. This is because the antifungal property, stability and image stability of the stabilizer improve.

Any means of deionization can be used, as long as the Ca and Mg ion concentration of the treated washing water is not more than 5 ppm, and it is preferable to use an ion exchange resin or reverse osmotic membrane treatment singly or in combination.

Ion exchange resins and reverse osmotic membranes are described in Journal of Technical Disclosure Nos. 87-1984 and 89-20511.

The salt concentration in the stabilizer is preferably not more than 1000 ppm, more preferably not more than 800 ppm.

Although stabilizing need not be followed by washing, rinsing with a small amount of water, surface washing, etc may be carried out as necessary within a very short time.

The color developing agent used for the color developing process includes amino phenol compounds and p-phenylenediamine compounds. In the present invention, p-phenylenediamine compounds having a water-soluble group are preferred.

At least one water-soluble group is present on the amino group or benzene nucleus of the p-phenylenediamine compound. Examples of preferred water-soluble groups include:

$$-(CH_2)_n-CH_2OH,$$

$$-(CH_2)_m-NHSO_2-(CH_2)_n-CH_3,$$

$$-(CH_2)_m-O-(CH_2)_n-CH_3,$$

$$-(CH_2CH_2O)_nC_mH_{2m+1}$$

(m and n independently represent an integer), —COOH group and —$SO_3H$ group.
Examples of color developing agents preferably used for the present invention are given below.
A-1
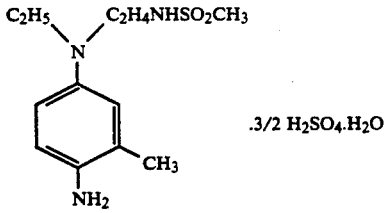
A-2
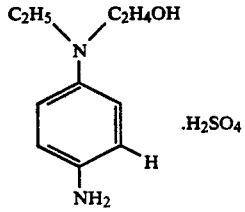
A-3
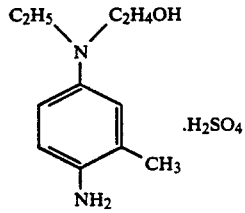
A-4
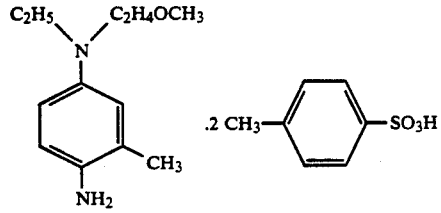
A-5
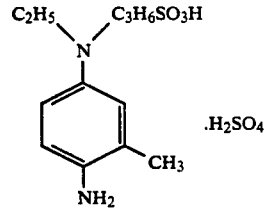
A-6
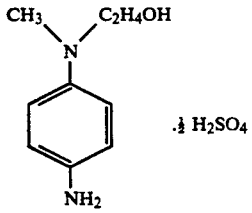
A-7
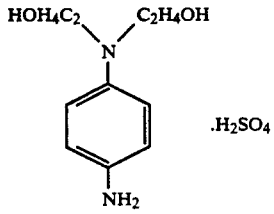
-continued
A-8
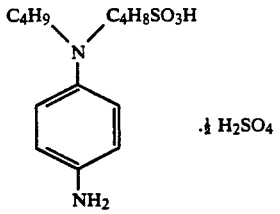
A-9
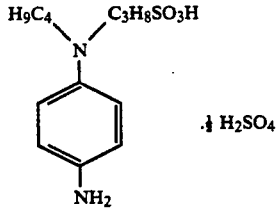
A-10
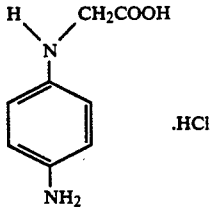
A-11
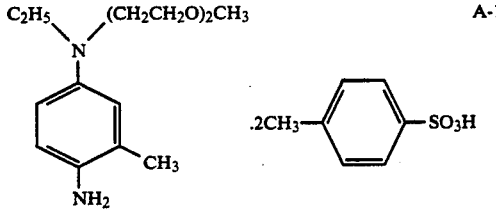
A-12
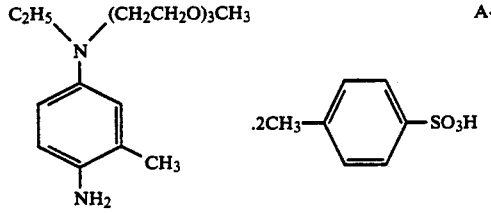
A-13
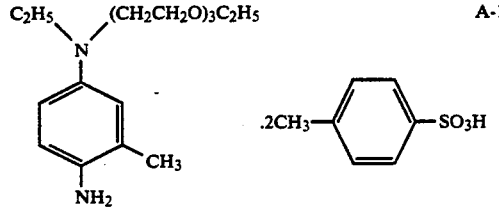
A-14
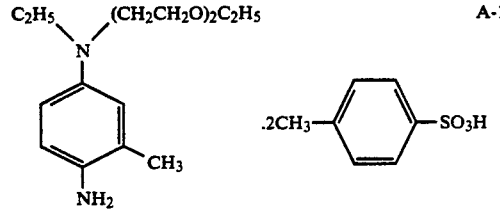

-continued

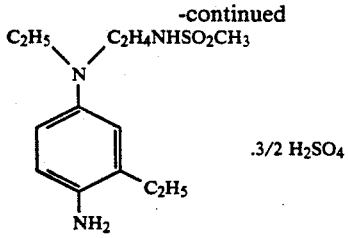

A-15

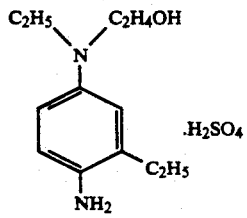

A-16

Of the color developing agents shown above, Exemplified Compound Nos. A-1, A-2, A-3, A-4, A-6, A-7 and A 15 are preferred.

The amount of color developing agent added is preferably not less than $0.5\times10^{-2}$ mol, more preferably $1.0\times10^{-2}$ to $1.0\times10^{-1}$ mol, and ideally $1.5\times10^{-2}$ to $7.0\times10^{-2}$ mol per liter of color developer.

The color developing agent is used normally in the form of a salt such as hydrochloride, sulfate or p-toluenesulfonate.

The color developer used for the color developing process may contain an alkali which is commonly used in developer, such as sodium hydroxide, potassium hydroxide, ammonium hydroxide, sodium carbonate, potassium carbonate, sodium sulfate, sodium metaborate or borax, and may also contain various additives such as benzyl alcohol, a halogenated alkali such as potassium bromide or potassium chloride, and citrazinic acid as a development regulator, hydroxylamine, a hydroxylamine derivative such as diethylhydroxylamine, a hydrazine derivative such as hydrazinodiacetic acid or sulfite as a preservative.

Various defoaming agents and surfactants and organic solvents such as methanol, dimethylformamide and dimethylsulfoxide may also be added. The pH of the color developer is normally not less than 7, preferably 9 to 13.

The color developer may contain as necessary an antioxidant such as tetronic acid, tetronimide, 2-anilinoethanol, dihydroxyacetone, hydroxamic acid, pentose, hexose or pyrogallol-1,3-dimethyl ether.

The color developer may contain various chelating agents as sequestering agents. Examples thereof include aminopolycarboxylic acids such as ethylenediaminetetraacetic acid and diethylenetriaminepentaacetic acid, organic phosphonic acids such as 1 hydroxyethylidene-1,1-diphosphonic acid, aminopolyphosphonic acids such as aminotri(methylenephosphonic acid) and ethylenediaminetetraphosphonic acid, oxycarboxylic acids such as citric acid and gluconic acid, phosphonocarboxylic acids such as 2-phosphonobutane-1,2,4-tricarboxylic acid and polyphosphoric acids such as tripolyphosphoric acid and hexametaphosphoric acid.

In continuous processing, the amount of color developer replenisher is preferably not more than 1.5 1, more preferably 250 to 900 ml, and still more preferably 300 to 700 ml per 1.0 $m^2$ of light-sensitive material for a color negative film.

The bleaching agent used in the bleacher or bleach-fixer for the present invention includes the ferric complex salts of organic acid represented by the following formula A or B and ferric complex salts of Exemplified Compound Nos. A'-1 through 16.

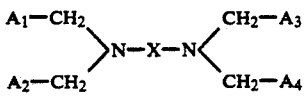

Formula A wherein $A_1$ through $A_4$, whether identical or not, independently represent —$CH_2OH$, —COOM or —$PO_3M_1M_2$ (M, $M_1$ and $M_2$ independently represent a hydrogen atom, alkali metal or ammonium); X represents a substituted or unsubstituted alkylene group having 3 to 6 carbon atoms.

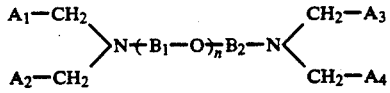

Formula B wherein $A_1$ through $A_4$ have the same definitions as with Formula A; n represents an integer of 1 to 8. $B_1$ and $B_2$, whether identical or not, independently represent a substituted or unsubstituted alkylene group having 2 to 5 carbon atoms.

The compound represented by Formula A is described in detail.

$A_1$ through $A_4$, whether identical or not, independently represent —$CH_2OH$, —COM or —$PO_3M_1M_2$ (M, $M_1$ and $M_2$ independently represent a hydrogen atom, alkali metal such as sodium or potassium, or ammonium); X represents a substituted or unsubstituted alkylene group having 3 to 6 carbon atoms such as trimethylene, tetramethylene or pentamethylene. Examples of the substituent include hydroxyl groups and alkyl groups having 1 to 3 carbon atoms.

Preferred compounds represented by Formula A are exemplified as follows.

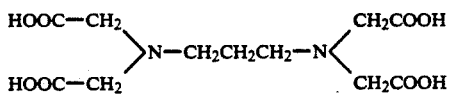

A-1

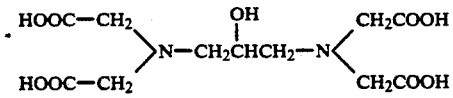

A-2

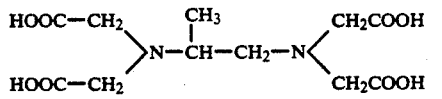

A-3

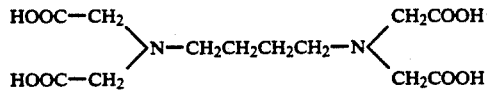

A-4

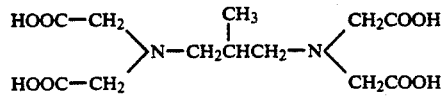

A-5

-continued

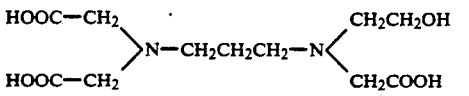
A-6

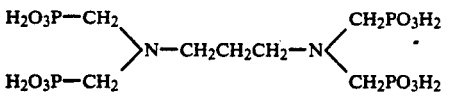
A-7

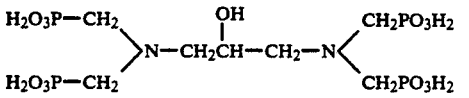
A-8

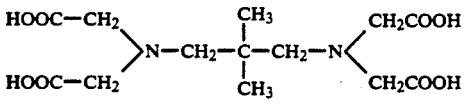
A-9

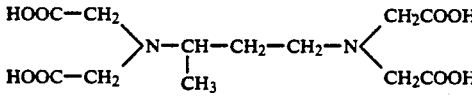
A-10

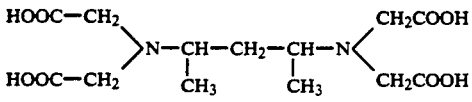
A-11

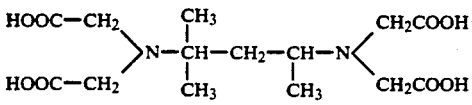
A-12

Ferric complex salts of these compounds A-1 through A-12 may be used in the form of sodium salt, potassium salt or ammonium salt. From the viewpoint of the desired effect of the invention and solubility, ammonium salts of these ferric complex salts are preferably used.

Of the compounds shown above, A-1, A-3, A-4, A-5 and A-9 are preferably used, with more preference given to A-1.

The compound represented by Formula B is described in detail.

$A_1$ through $A_4$ have the same definitions as with Formula A; n represents an integer of 1 to 8. $B_1$ and $B_2$, whether identical or not, independently represent a substituted or unsubstituted alkylene group having 2 to 5 carbon atoms, such as ethylene, trimethylene, tetramethylene or pentamethylene. Examples of the substituent include hydroxyl groups and lower alkyl groups having 1 to 3 carbon atoms such as methyl, ethyl and propyl groups.

Preferred compounds represented by Formula B are exemplified as follows.

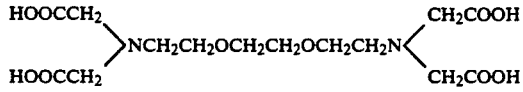
B-1

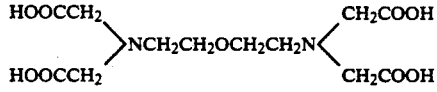
B-2

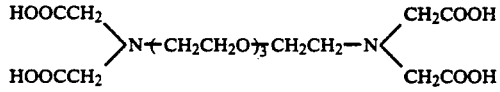
B-3

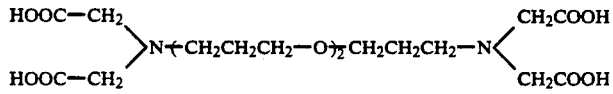
B-4

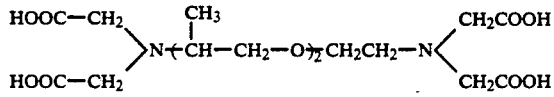
B-5

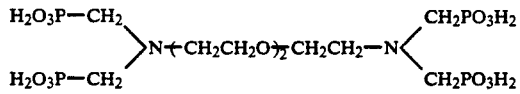
B-6

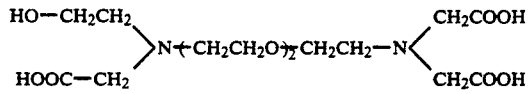
B-7

Ferric complex salts of these compounds B-1 through B-7 may be used in the form of sodium salt, potassium salt or ammonium salt.

Of the compounds shown above, B-1, B-2 and B-7 are preferably used for the present invention, with more preference given to B-1.

The amount of ferric complex salt of organic acid added is preferably 0.1 to 2.0 mol, more preferably 0.15 to 1.5 mol per liter of bleacher.

Examples of preferable bleaching agents based on an iron complex salt of a compound represented by Formula A or B for the bleacher or bleach fixer include ferric complex salts of the following compounds such as salts of ammonium, sodium, potassium and triethanolamine, but these are not to be construed as limitative.

A'-1: Ethylenediaminetetraacetic acid

A'-2: trans-1,2-cyclohexanediaminetetraacetic acid

A'-3: Dihydroxyethylglycine

A'-4: Ethylenediaminetetrakismethylenephosphonic acid
A'-5: Nitrilotrismethylenephosphonic acid
A'-6: Diethylenetriaminepentakismethylenephosphonic acid
A'-7: Diethylenetriaminepentaacetic acid
A'-8: Ethylenediaminediorthohydroxyphenylacetic acid
A'-9: Hydroxyethylethylenediaminetriacetic acid
A'-10: Ethylenediaminedipropionic acid
A'-11: Ethylenediaminediacetic acid
A'-12: Hydroxyethyliminodiacetic acid
A'-13: Nitrilotriacetic acid
A'-14: Nitrilotripropionic acid
A'-15: Triethylenetetraminehexaacetic acid
A'-16: Ethylenediaminetetrapropionic acid The bleacher may incorporate one or more ferric complex salts of the compounds A'-1 through A'-16 in combination with a ferric complex salt of the compound represented by Formula A or B.

When using two or more ferric complex salts of organic acid in combination, it is preferable for the enhancement of the effect of the present invention that the ferric complex salt of a compound represented by Formula A or B account for not less than 70 mol %, more preferably not less than 80 mol %, still more preferably not less than 90 mol %, and ideally not less than 95 mol %.

The iron (III) complex salt of organic acid may be used in the form of a complex salt as such or may be converted to an iron (III) ion complex salt by reaction in a solution between an iron (III) salt such as ferric sulfate, ferric chloride, ferric acetate, ferric ammonium sulfate or ferric phosphate and aminopolycarboxylic acid or its salt. When using in the form of a complex salt as such, one or more complex salts may be used. When using a ferric salt and aminopolycarboxylic acid to form a complex salt in a solution, one or more ferric salts may be used. Similarly, one or more aminopolycarboxylic acids may be used.

In either case, aminopolycarboxylic acid may be used in excess for the formation of iron (III) ion complex salt.

The bleach-fixer or bleacher containing the iron (III) ion complex may incorporate an ion complex salt of a metal other than iron, such as cobalt, copper, nickel or zinc.

The rapid processing effect can be enhanced by incorporating in the bleacher, bleach-fixer or fixer at least one of the imidazole described in Japanese Patent O.P.I. Publication No. 295258/1989 and its derivatives and the compounds represented by the formulas I through IX described in the same patent application.

In addition to the bleaching accelerators described above, it is possible to use the compounds exemplified in Japanese Patent Application No. 123456/1987, pp. 51–115, the compounds exemplified in Japanese Patent O.P.I. Publication No. 17445/1988, pp. 22–25, and the compounds described in Japanese Patent O.P.I. Publication Nos. 95630/1978 and 28426/1978.

These bleaching accelerators may be used singly or in combination. The amount of their addition is preferably about 0.01 to 100 g, more preferably 0.05 to 50 g, and ideally 0.05 to 15 g per liter of bleacher.

The bleaching accelerator may be added and dissolved as such, but it is the common practice to add it in solution in water, alkali or organic acid, and an organic solvent such as methanol, ethanol or acetone may be appropriately used to dissolve it before its addition.

The temperature of the bleacher or bleach-fixer is normally 20° to 50° C., and desirably 25° to 45° C.

The pH of the bleacher is preferably not more than 6.0, more preferably not less than 1.0 and not more than 5.5. The pH of the bleach-fixer is preferably 5.0 to 9.0, more preferably 6.0 to 8.5.

It should be noted that the pH of the bleacher or bleach-fixer means the pH in the silver halide light-sensitive material processing bath and is clearly differentiated from the pH of the replenisher.

The bleacher or bleach-fixer normally incorporates a halide such as ammonium bromide, potassium bromide or sodium bromide. Various fluorescent brightening agents, defoaming agents and surfactants may be added.

The amount of replenisher for bleacher or bleach-fixer is normally not more than 500 ml, preferably 20 to 400 ml, and ideally 40 to 350 ml per $m^2$ of silver halide color photographic light-sensitive material. As the amount of replenisher decreases, the effect of the present invention increases.

In the present invention, to increase the activity of the bleacher or bleach-fixer, air or oxygen sparging may be carried out in the processing bath and in the replenisher storage tank if necessary, and an appropriate oxidant such as hydrogen peroxide, hydrobromate or persulfate may be appropriately added.

The fixing agent used in the fixer or bleach-fixer for the present invention is preferably a thiocyanate or thiosulfate. The amount of thiocyanate is preferably at least 0.1 mol/l, more preferably not less than 0.3 mol/l, and still more preferably not less than 0.5 mol/l for processing a color negative film. The amount of thiosulfate is preferably at least 0.2 mol/l, more preferably not less than 0.5 mol/l for processing a color negative film.

In addition to these fixing agents, the fixer or bleach-fixer for the present invention may contain one or more pH buffers selected from the group comprising various acids and salts such as boric acid, borax, sodium hydroxide, potassium hydroxide, sodium carbonate, potassium carbonate, sodium bicarbonate, potassium bicarbonate, acetic acid, sodium acetate and ammonium hydroxide.

It is also desirable to add a large amount of a rehalogenating agent such as an alkali halide or ammonium halide, e.g., potassium bromide, sodium bromide, sodium chloride or ammonium bromide. Compounds which are known as additives to fixer or bleach-fixer such as alkylamines and polyethylene oxides may also be added.

Silver may be recovered from the fixer or bleach-fixer for the present invention by a known method.

The amount of replenisher for the fixer or bleach-fixer for the invention is preferably not more than 900 ml, more preferably 20 to 750 ml, and ideally 50 to 620 ml per $m^2$ of light-sensitive material. The pH of the fixer is preferably 4 to 8.

A compound represented by the formula FA described in Japanese Patent Application No. 295258/1989, pp. 56 may be added to the processing solution capable of fixation for the present invention, which not only enhances the effect of the invention but also offers an additional effect in that sludge formation in the processing solution capable of fixation is significantly suppressed during prolonged processing of a small amount of light-sensitive material.

The compound represented by Formula FA can be synthesized by the methods described in U.S. Pat. Nos. 3,335,161 and 3,260,718. These compounds represented by Formula FA may be used singly or in combination.

Use of these compounds represented by Formula FA yields good results when they are added in an amount of 0.1 to 200 g per liter of processing solution.

Although the processing times respectively for the bleacher and fixer for the present invention may be set at any level, each processing time is preferably shorter than 3 minutes and 30 seconds, more preferably 10 seconds to 2 minutes and 20 seconds, and ideally 20 seconds to 1 minute and 20 seconds. The processing time with bleach fixer is preferably shorter than 4 minutes, more preferably 10 seconds to 2 minutes and 20 seconds.

In the processing method of the present invention, it is a preferred mode of embodiment to conduct forced stirring of the bleacher, bleach-fixer or fixer. This is because it not only enhances the desired effect of the invention but also improves the rapid processing suitability. Here, forced stirring does not imply ordinary diffusive migration of solution but implies stirring by means of a stirrer. This forced stirring can be achieved by the methods described in Japanese Patent O.P.I. Publication Nos. 222259/1989 and 206343/1989.

In the present invention, prevention of bleach fogging, an additional effect of the invention, is effected when the crossover time between the color developing bath and the bleaching or bleach-fixing bath is within 10 seconds, preferably within 7 seconds.

The silver halide grains for the silver halide color photographic light-sensitive material (hereinafter referred to as the light-sensitive material or sensitive-material, where necessary) may comprise silver chloride, silver chlorobromide, silver iodobromide or silver chloroiodobromide, with preference given to silver iodobromide from the viewpoint of enhancement of the effect of the invention.

The average silver iodide content of the entire silver halide emulsion in the light-sensitive material is preferably 0.1 to 15 mol %, more preferably 0.5 to 12 mol %, and ideally 1 to 10 mol %.

The total amount of silver coated in the light-sensitive material is preferably not less than 2 g, more preferably not less than 3 g and not more than 10 g per $m^2$ of light-sensitive material.

The average grain size of the entire silver halide emulsion in the light-sensitive material is preferably not more than 2.0 μm, more preferably 0.1 to 1.2 μm.

When the silver halide emulsion contains grains having an average value of less than 5 for grain size/grain thickness ratio, it is preferable from the viewpoint of desilvering property that the grain size distribution be monodispersed.

Here, grain diameter is defined as the diameter of the silver halide grain when it is spherical or the diameter converted from a circle with the same area from the projected image of the silver halide grain when it is not spherical.

A highly monodispersed emulsion preferred for the present invention has a distribution width of not more than 20%, more preferably not more than 15%, defined by the following equation.

(Grain size standard deviation/average grain diameter)×100=distribution width (%)

The crystal configuration of the silver halide grains may be normal crystal, twin crystal or any other crystal, and any ratio of the [1.0.0] plane and the [1.1.1] plane is usable. With respect to the crystal structure of these silver halide grains, it may be uniform from the core to the outer portion and may be of the core shell type wherein the core and the outer portion are of different layer structures. These silver halides may be of the type wherein latent images are formed mainly on the surface, or of the type wherein latent images are formed mainly inside the grains. Moreover, tabular grains of silver halide such as those described in Japanese Patent O.P.I. Publication No. 113934/1983 and Japanese Patent Application No. 170070/1984 may be used.

The silver halide grains may be prepared by any of the acid method, neutral method, ammoniacal method and other methods.

It is also possible to use the method in which seed grains are formed by the acid method and are grown to a given size by the ammoniacal method. In growing silver halide grains, it is preferable to control the pH, pAg and other factors in the reactor and to sequentially add and mix silver ions and halide ions in an amount according to the rate of growth of silver halide grains described in Japanese Patent O.P.I. Publication No. 48521/1979 at the same time.

The silver halide grains are preferably prepared as above. The composition containing said silver halide grains is referred to as silver halide emulsion.

These silver halide emulsions may be chemically sensitized with active gelatin, sulfur sensitizers such as allylthiocarbamide, thiourea and cystine, selenium sensitizers, reduction sensitizers such as stannate, thiourea dioxide and polyamine, noble metal sensitizers such as gold sensitizers, specifically potassium aurothiocyanate, potassium chloroaurate, 2-aurothio-3-methylbenzothiazolium chloride, sensitizers based on water-soluble salts such as ruthenium, palladium, platinum, rhodium and iridium, specifically ammonium chloropalladate, potassium chloroplatinate and sodium chloropalladate (some of which act as a sensitizer or antifogging agent, depending upon the amount), used singly or in combination (e.g., a gold sensitizer and a sulfur sensitizer, and a gold sensitizer and a selenium sensitizer).

The silver halide emulsion is chemically ripened by the addition of a sulfur-containing compound. Before, during or after this chemical ripening, at least one nitrogen-containing heterocyclic compound containing at least one hydroxytetrazaindene and a mercapto group may be added.

The silver halide may be optically sensitized by the addition of a sensitizing dye at $5\times10^{-8}$ to $3\times10^{-3}$ mol per mol of silver halide, for instance, in order to provide light sensitivity in the desired wavelength range. Various sensitizing dyes can be used, whether singly or in combination.

The coupler represented by Formula 2eq-1 for the present invention (hereinafter referred to as 2-equivalent coupler, where necessary) is described below.

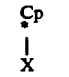

Formula 2eq-1 wherein Cp represents a coupler residue; * represents a coupler coupling site; X represents a group which splits off upon dye formation by coupling with the oxidation product of an aromatic primary amine based color developing agent.

Typical examples of the yellow coupler residue represented by Cp are given in U.S. Pat. Nos 2,298,443, 2,407,210, 2,875,057, 3,048,194, 3,265,506 and 3,447,928, "Farbkupplereine Literaturubersiecht Agfa Mitteilung (Band II)", pp. 126–156 (1961) and other publications. Of these yellow coupler residues, acylacetoanilides such as benzoylacetoanilide and pivaloylacetoanilide are preferred.

Typical examples of the magenta coupler residue are given in U.S. Pat. Nos. 2,369,489, 2,343,703, 2,311,082, 2,600,788, 2,908,573, 3,062,653, 3,152,896, 3,519,429, 3,725,067 4,540,654 and Japanese Patent O.P.I. Publication No. 162548/1984, the above-mentioned Agfa Mitteilung (Band II), pp. 126–156 (1961) and other publications. Of these magenta coupler residues, pyrazolones or pyrazoloazoles such as pyrazoloimidazole and pyrazolotriazole are preferred.

Typical examples of the cyan coupler residue are given in U.S. Pat. Nos. 2,367,531, 2,423,730, 2,474,293, 2,772,162, 2,895,826, 3,002,836, 3,034,892 and 3,041,236, the above-mentioned Agfa Mitteilung (Band II), pp. 156–175 (1961) and other publications. Of these cyan coupler residues, phenols or naphthols are preferred.

Examples of the leaving group represented by X include halogen atoms, monovalent groups such as an alkoxy group, aryloxy group, heterocyclic oxy group, acyloxy group, alkylthio group, arylthio group, heterocyclic thio group

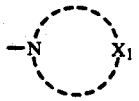

(wherein $X_1$ represents a group of atoms necessary to form a 5- or 6-membered ring along with at least one atom selected from the nitrogen atom, carbon atom, oxygen atom, nitrogen atom and sulfur atom in the formula), acylamino group and sulfonamide group, and divalent groups such as an alkylene group; when the leaving group is a divalent group, X forms a dimer.

Examples of the leaving group are given below.

Halogen atoms: Chlorine, bromine, fluorine

Alkoxy groups:

$-OC_2H_5$, $-OCH_2CONHCH_2CH_2OCH_3$,

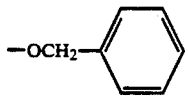

$-OCH_2CH_2SO_2CH_3$, $-OCH(CH_3)COOH$, $-OCH(C_{12}H_{25})COOH$, $-OCHCOOH$, $-OCH_2CH_2SCH(C_{12}H_{25})COOH$, $-OCH_2N$

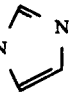

Aryloxy groups:

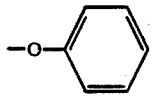

, $-O-C_6H_4-COOH$,

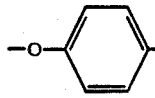

$-O-C_6H_4-NO_2$,

-continued

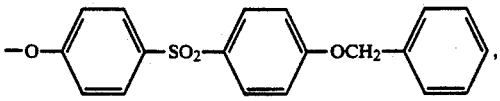

,

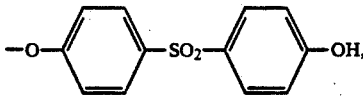

$-O-C_6H_4-OH$,

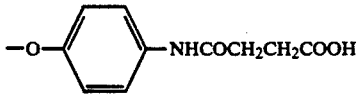

$-O-C_6H_4-NHCOCH_2CH_2COOH$

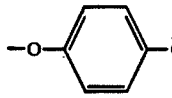

$-O-C_6H_4-OCH_3$,

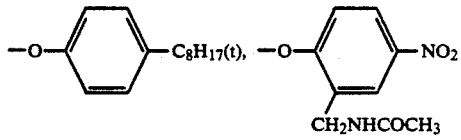

$-O-C_6H_4-C_8H_{17}(t)$, $-O-C_6H_3(CH_2NHCOCH_3)-NO_2$

Heterocyclic oxy groups:

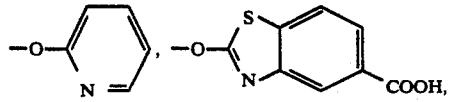

, $-O-$

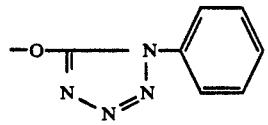

Acyloxy groups:

$-OCOCH_3$, $-OCOCH=CH-C_6H_5$, $-OCOC_4H_9$, $-OCO-C_6H_5$, $-OCOCH_2CH_2COOH$

Alkylthio groups:

$-SCH_3$, $-SC_2H_5$, $-SC_8H_{17}$, $-SC_{12}H_{25}$, $-SCH_2-C_6H_5$, $-SCH_2CH_2N(C_2H_5)_2$, $-SCH_2COOC_2H_5$, $-SCH_2CH_2OC_2H_5$, $-SCH_2CH_2O-C_6H_5$,

Arylthio groups:

-continued
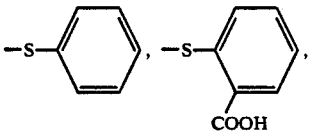
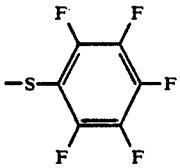
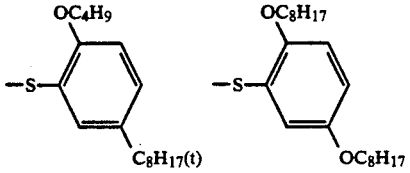
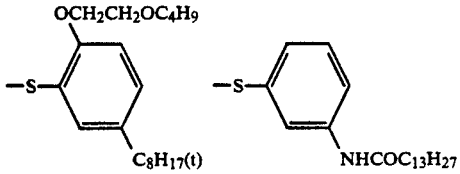
Heterocyclic thio groups:
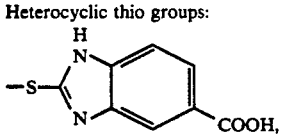
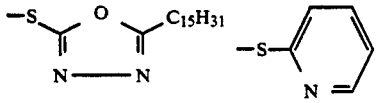
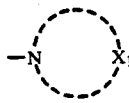
$X_1$: Pyrazolyl group, imidazolyl group, triazolyl group, tetrazolyl group,
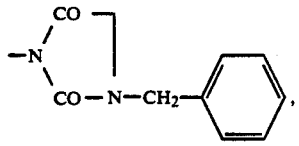
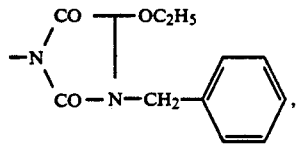
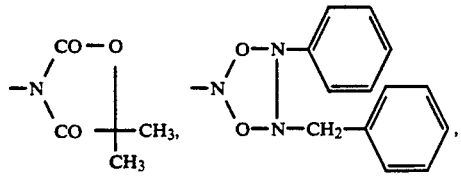
-continued
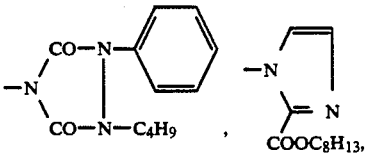
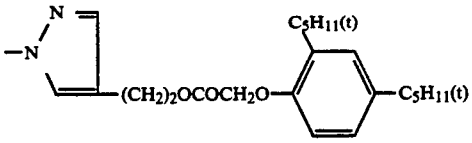
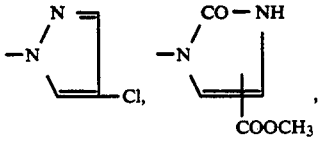
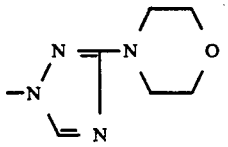
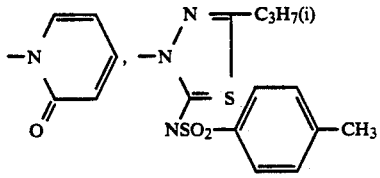
Acylamino groups:
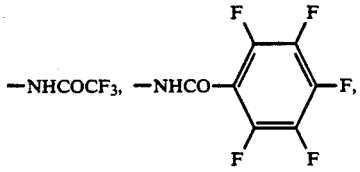
$-NHCO(CF_2CF_2)_2H$
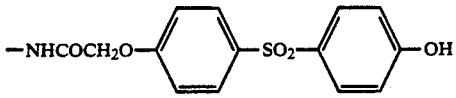
Sulfonamide groups:
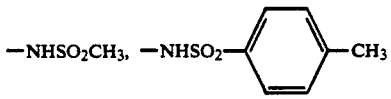
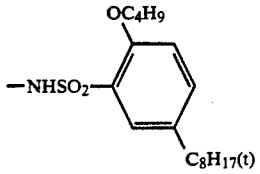
Alkylene groups:

-continued

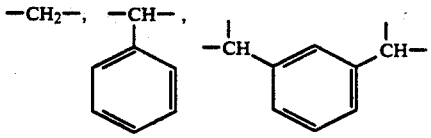

The 2-equivalent yellow coupler is preferably represented by Formula 2-eq-2 or 2eq-3.

Formula 2eq-2

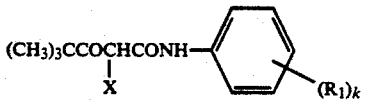

Formula 2eq-3

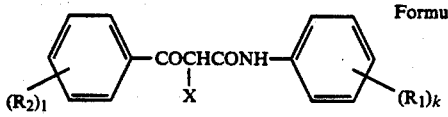

With respect to Formulas 2eq-2 and 2eq-3, $R_1$ and $R_2$ independently represent a hydrogen atom or substituent; k and 1 independently represent an integer of 1 to 5, when k and 1 are 2 or more, $R_1$ and $R_2$ may be identical or not; X has the same definition as X in Formula 2eq-1.

Examples of the substituent represented by $R_1$ or $R_2$ include halogen atoms, alkyl, cycloalkyl, aryl, heterocyclic and other groups which bind directly or via a divalent atom or group.

Examples of the divalent atom or group include an oxygen atom, nitrogen atom, sulfur atom, carbonylamino, aminocarbonyl, sulfonylamino, aminosulfonyl, amino, carbonyl, carbonyloxy, oxycarbonyl, ureylene, thioureylene, thiocarbonylamino, sulfonyl and sulfonyloxy.

The alkyl, cycloalkyl, aryl and heterocyclic groups exemplified for the substituent represented by $R_1$ or $R_2$ include those having a substituent. Examples of the substituent include halogen atoms, nitro, cyano, alkyl, alenyl, cycloalkyl, aryl, alkoxyl, aryloxy, alkoxycarbonyl, aryloxycarbonyl, carboxyl, sulfo, sulfamoyl, carbamoyl, acylamino, ureide, urethane, sulonamide, heterocyclic ring, arylsulfonyl, alkylsulfonyl, arylthio, alkylthio, alkylamino, anilino, hydroxy, imido and acyl groups.

With respect to the 2-equivalent yellow coupler, examples of X include those exemplified for Formula 2eq-1, with preference given to an aryloxy group and

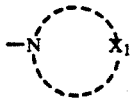

(wherein $X_1$ has the same definition as $X_1$ above).

Formula 2eq-2 includes the cases where $R_1$ or X forms a dimer or higher polymer. Formula 2eq-3 includes the cases where $R_1$, $R_2$ or X forms a dimer or higher polymer.

The 2-equivalent magenta coupler is preferably represented by formula 2eq-4, 2eq-5, 2eq-6 or 2eq-7.

Formula 2eq-4

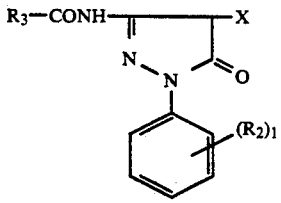

Formula 2eq-5

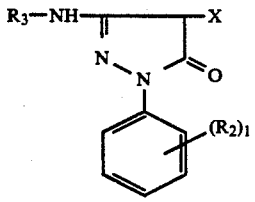

Formula 2eq-6

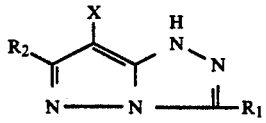

Formula 2eq-7

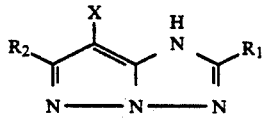

With respect to Formulas 2eq-4 through 2eq-7, $R_3$ represents a substituent; $R_1$, $R_2$, X and l have the same definitions as $R_1$, $R_2$, X and l in formulae 2eq-2 and 2eq-3; when l is 2 or more, the $R_2$ groups may be identical or not.

Examples of $R_1$ and $R_2$ include those exemplified for $R_1$ and $R_2$ in Formula 2eq-3. Examples of $R_3$ include alkyl, cycloalkyl, aryl and heterocyclic groups. These include those having a substituent. Examples of the substituent include those exemplified as the substituent possessed by the groups exemplified for $R_1$ and $R_2$ in Formula 2eq-2.

With respect to the 2-equivalent magenta coupler, examples of X include those exemplified for Formula 2eq-1, with preference given to a halogen atom, alkylthio group, arylthio group, aryloxy group, acyloxy group,

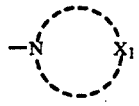

(wherein $X_1$ has the same definition as $x_1$ above) and alkylene group.

Formulae 2eq-4 and 2eq-5 include the cases where $R_2$, $R_3$ or X forms a dimer or higher polymer. Formulas 2eq-6 and 2eq-7 include the cases where $R_1$, $R_2$ or X forms a dimer or higher polymer.

The 2-equivalent cyan coupler is preferably represented by Formula 2eq-8, 2eq-9 or 2eq-10.

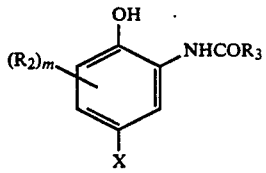

Formula 2eq-8

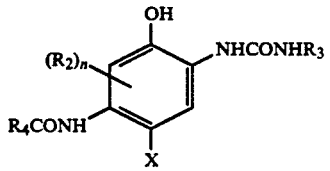

Formula 2eq-9

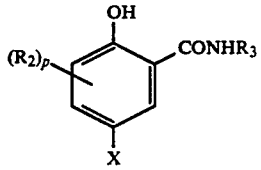

Formula 2eq-10

In these Formulae, $R_2$ and $R_3$ have the same definitions as $R_2$ and $R_3$ in Formula 2eq-4; $R_4$ represents a substituent; m represents an integer of 1 to 3; n represents an integer of 1 or 2; p represents an integer of 1 to 5; when m, n and p are 2 or more, the $R_2$ groups may be identical or not.

Examples of $R_2$ and $R_3$ include those exemplified for Formula 2eq-4. Examples of $R_4$ include those exemplified for $R_3$ in Formula 2eq-4.

With respect to the 2-equivalent cyan coupler, examples of X include those exemplified for Formula 2eq-1, with preference given to a halogen atom, alkoxy group, aryloxy group and sulfonamide group.

Formulas 2eq-8 and 2eq-10 include the cases where $R_2$, $R_3$ or X forms a dimer or higher polymer. Formula 2eq-9 includes the cases where $R_2$, $R_3$, $R_4$ or X forms a dimer or higher polymer.

Examples of the 2-equivalent couplers for the present invention are given below.

2-equivalent yellow couplers

Y-1

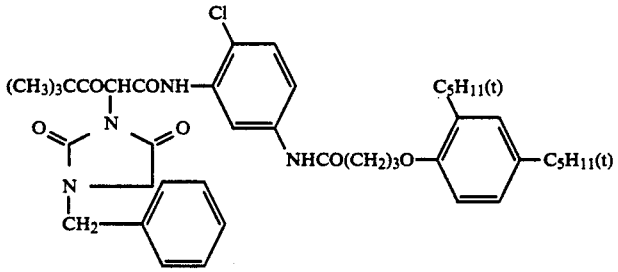

Y-2

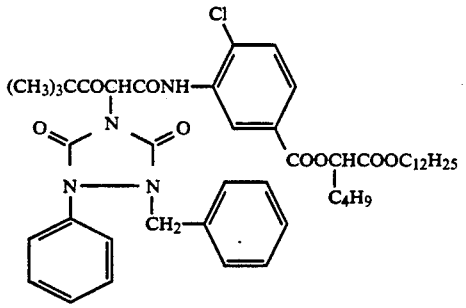

Y-3

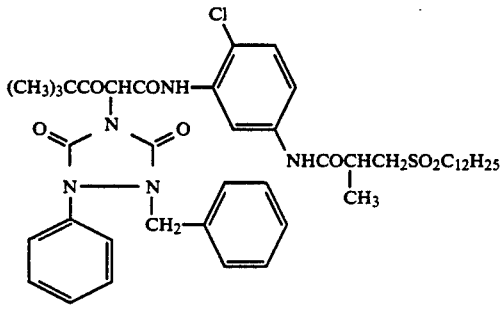

-continued
Y-4
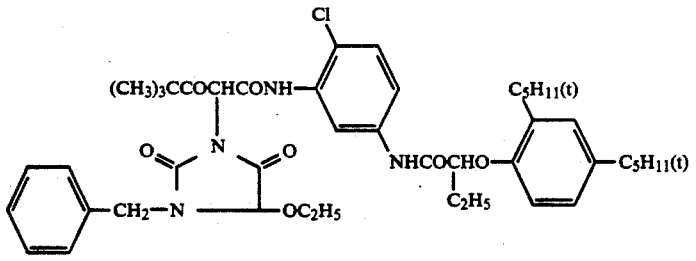
Y-5
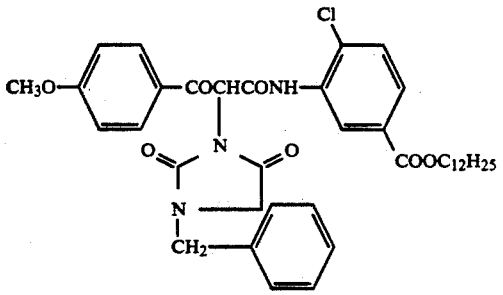
Y-6
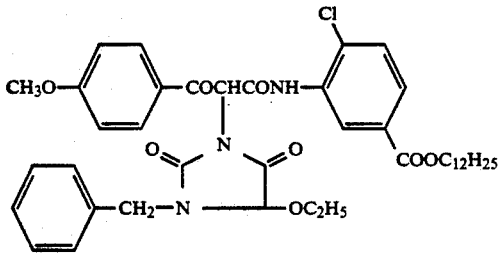
Y-7
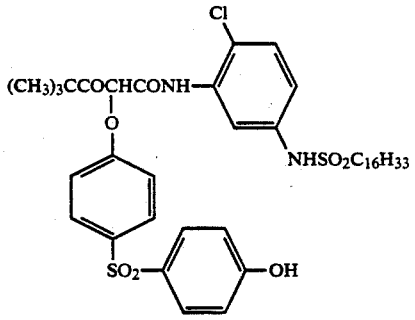
Y-8
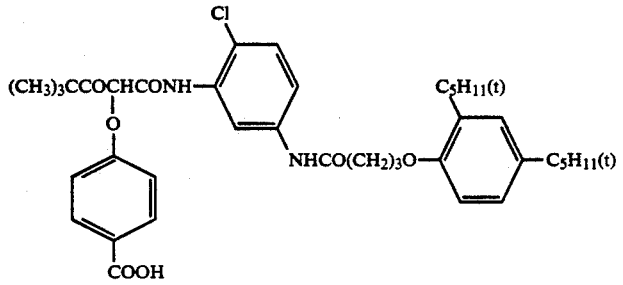

-continued
Y-9
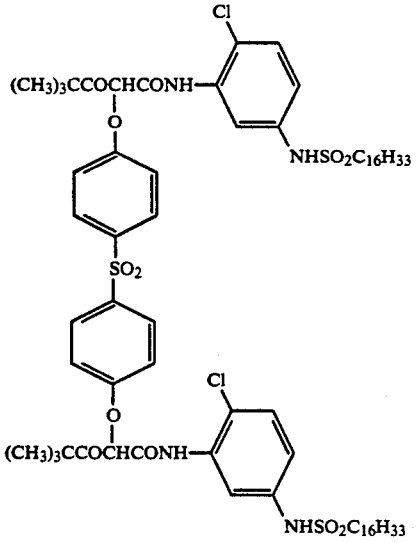
Y-10
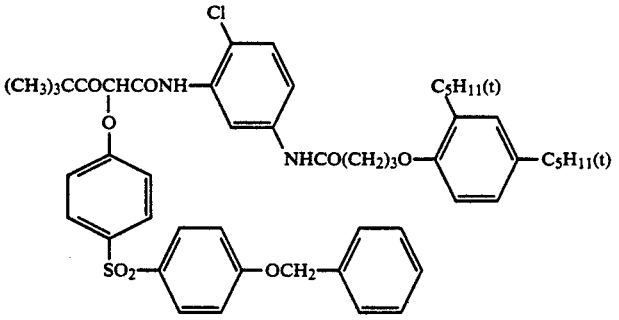
Y-11
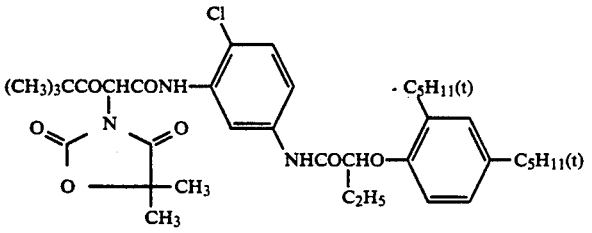
Y-12
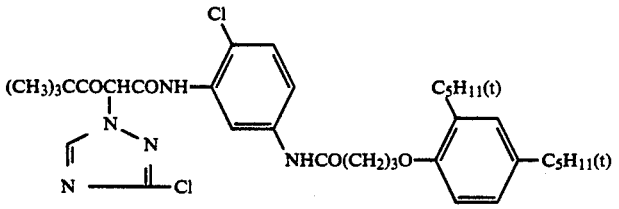
Y-13
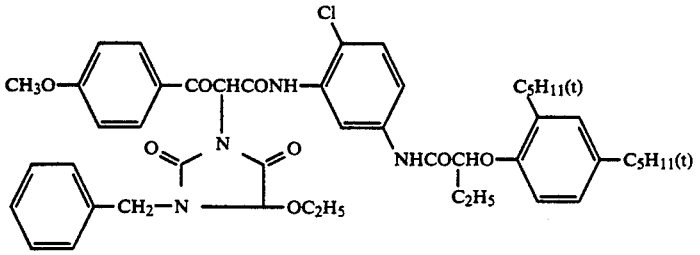

-continued
Y-14
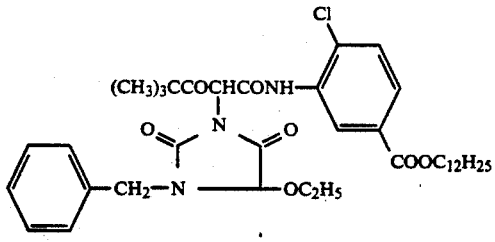
Y-15
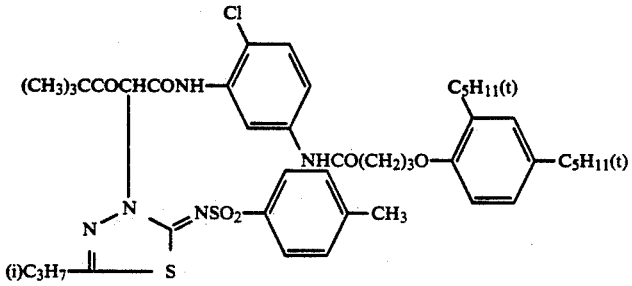
Y-16
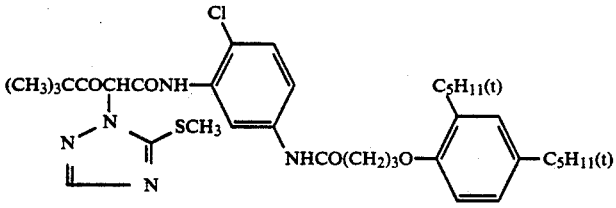
Y-17
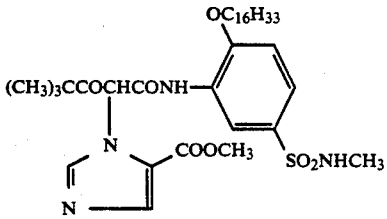
Y-18
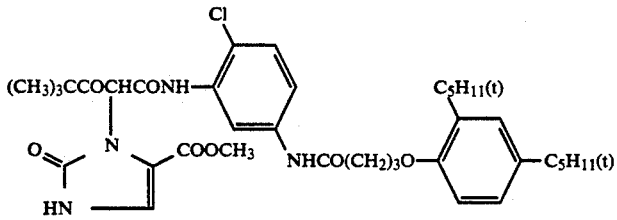
Y-19
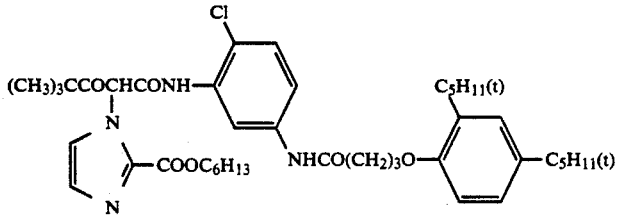

-continued
Y-20
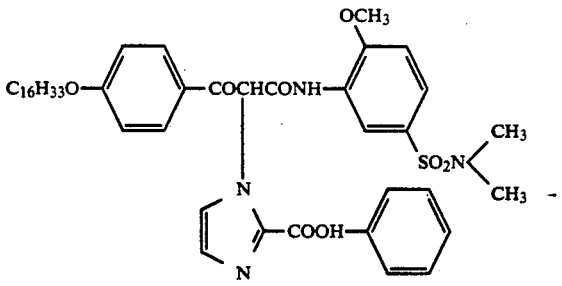
Y-21
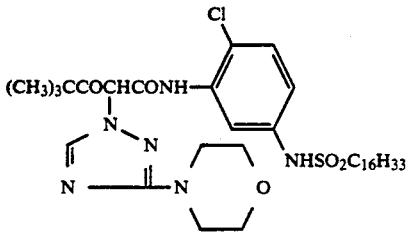
Y-22
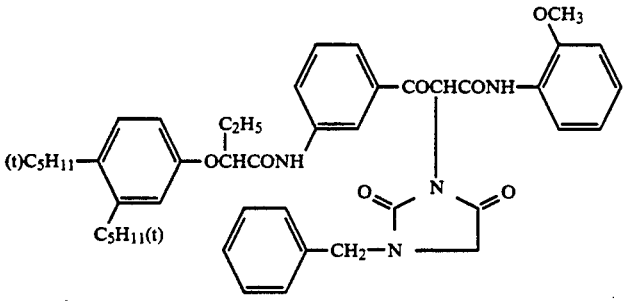
Y-23
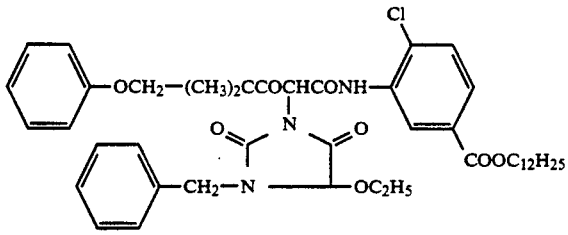
Y-24
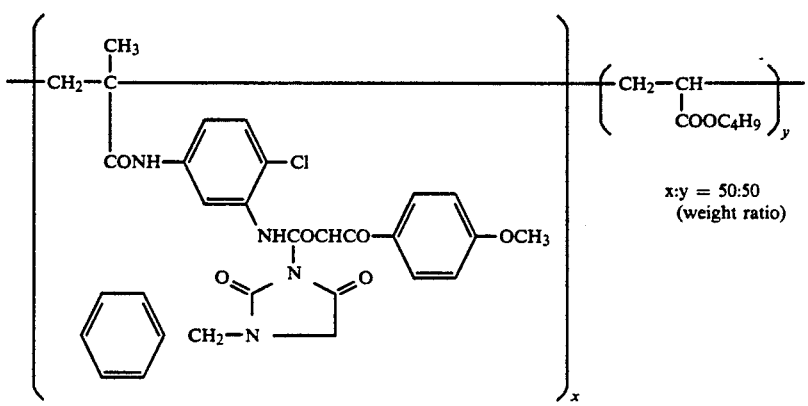
x:y = 50:50
(weight ratio)

-continued
Y-25
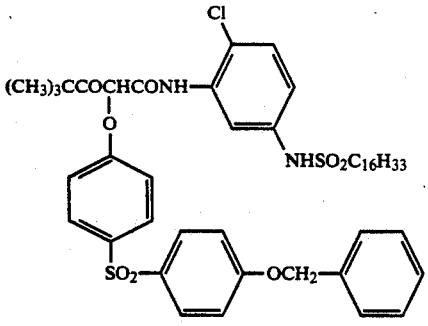
Y-26
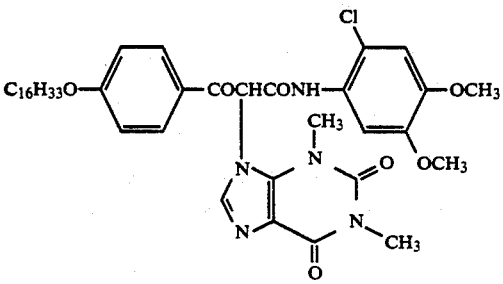
Y-27
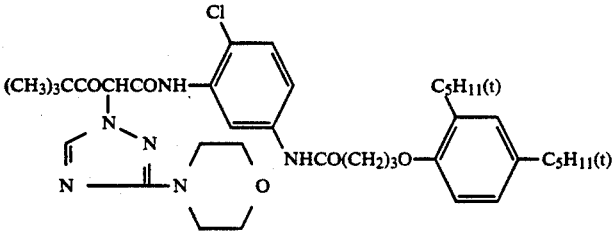
Y-28
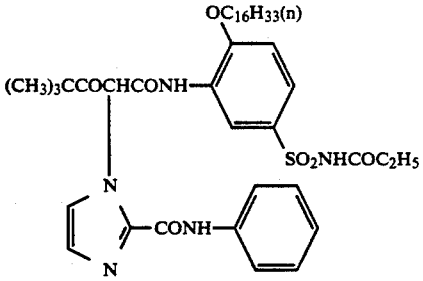
Y-29
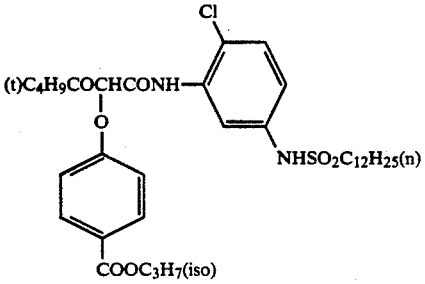

-continued
Y-30
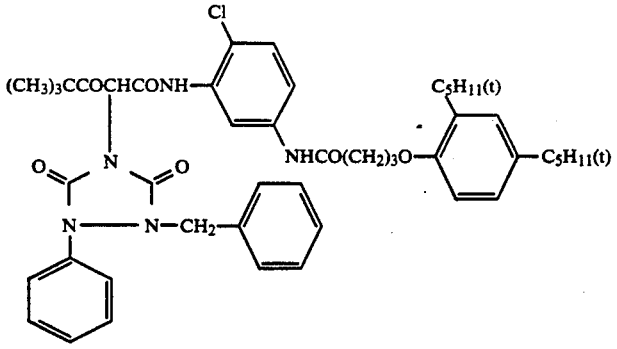
Y-31
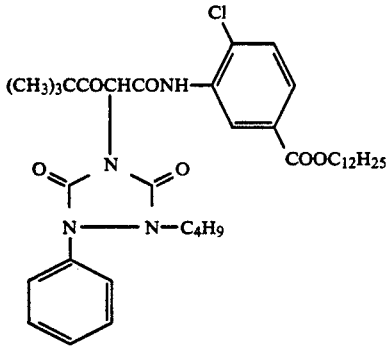
Y-32
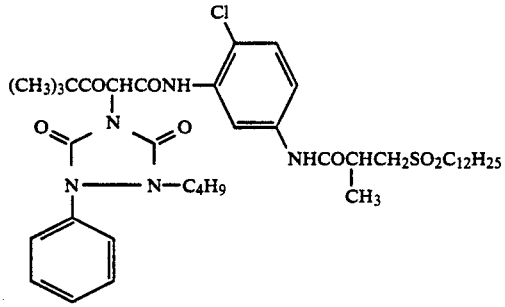
Y-33
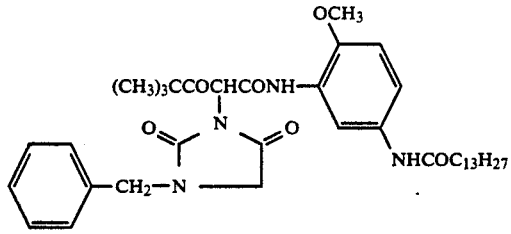
Y-34
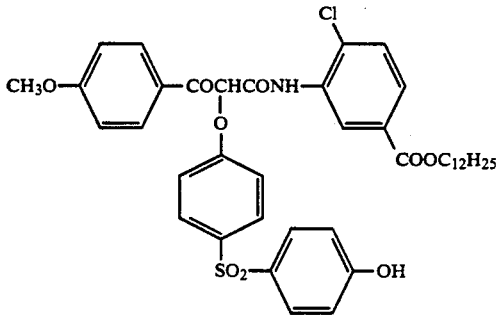

-continued
Y-35
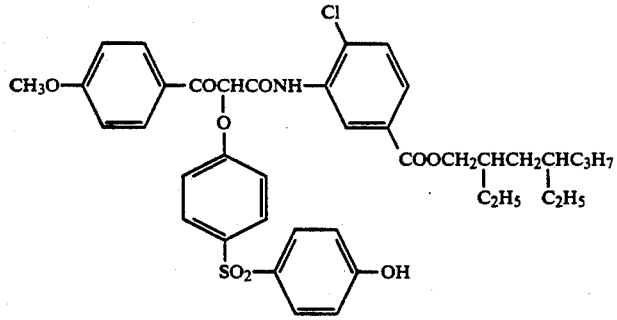
Y-36
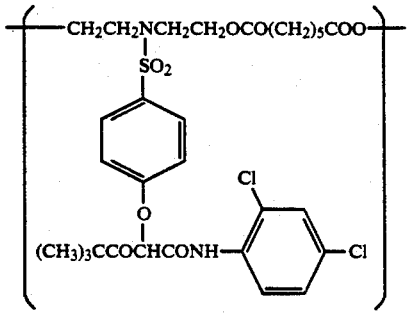
Y-37
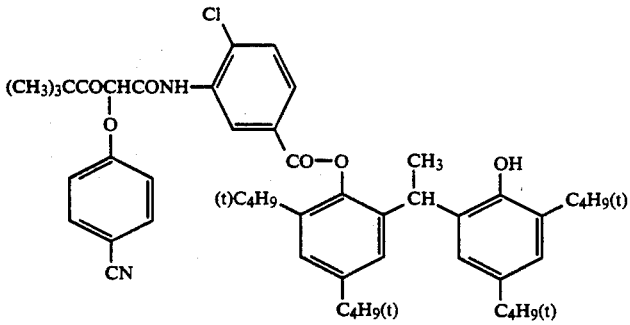
Y-38
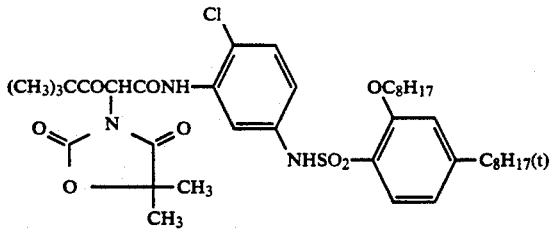
Y-39
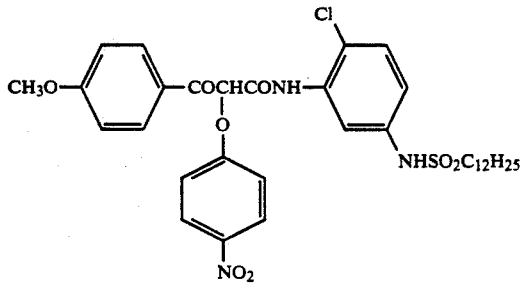
2-equivalent magenta couplers -continued
M-1
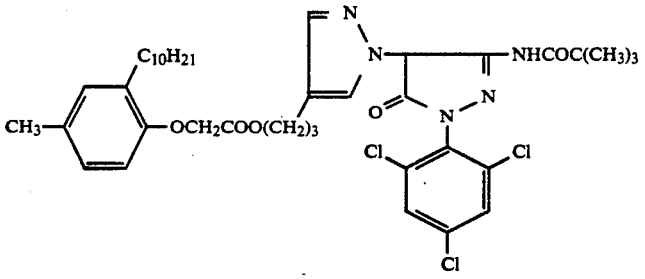
M-2
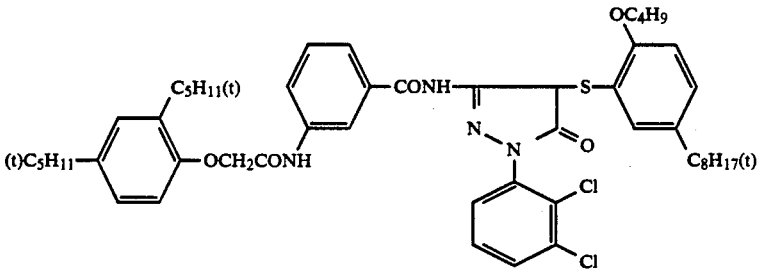
M-3
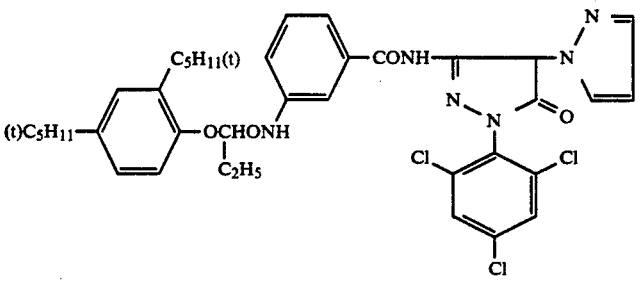
M-4
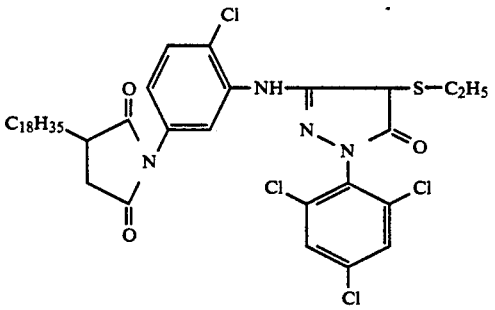
M-5
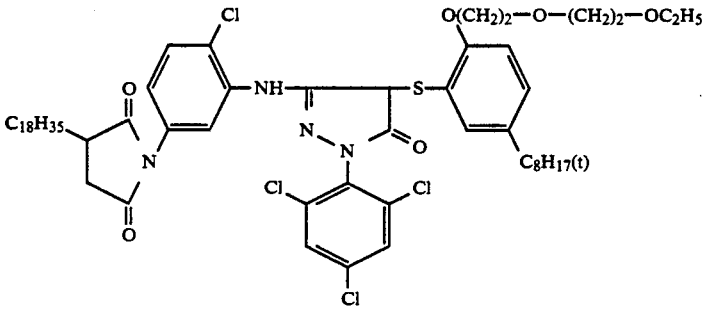

-continued
M-6
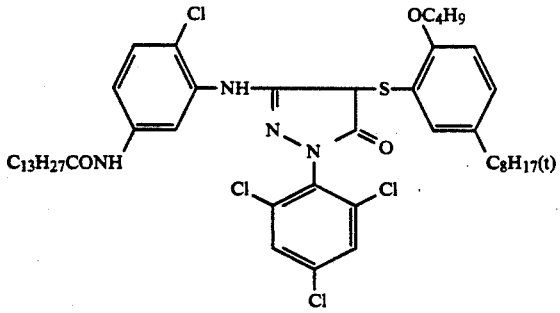
M-7
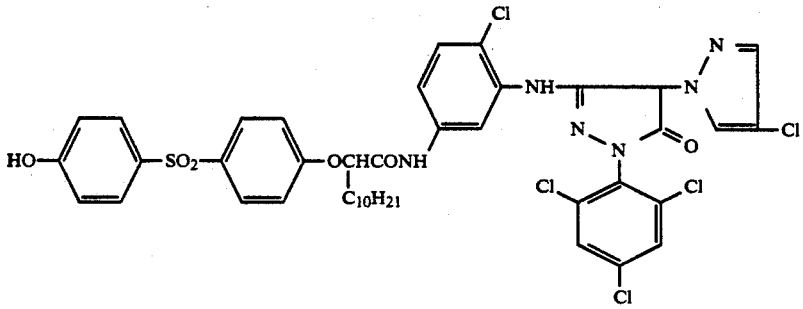
M-8
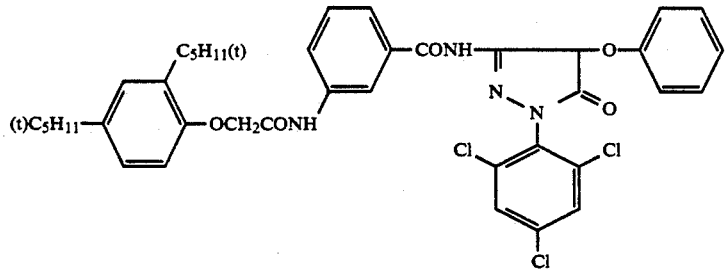
M-9
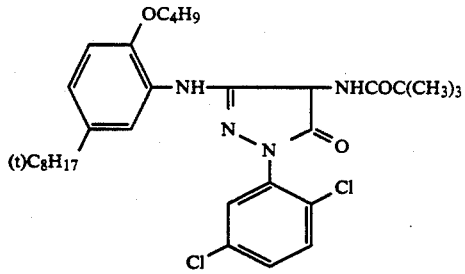
M-10
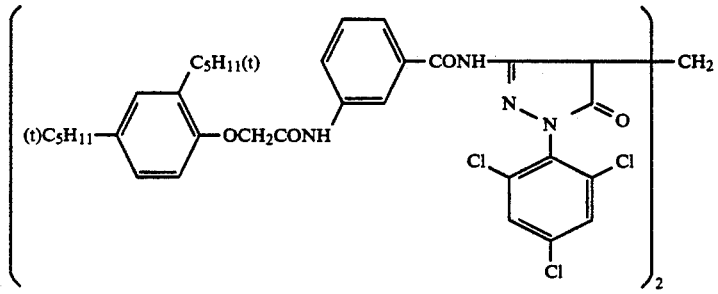

-continued
M-11
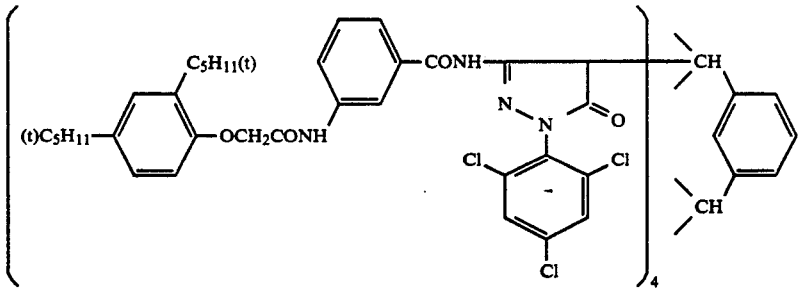
M-12
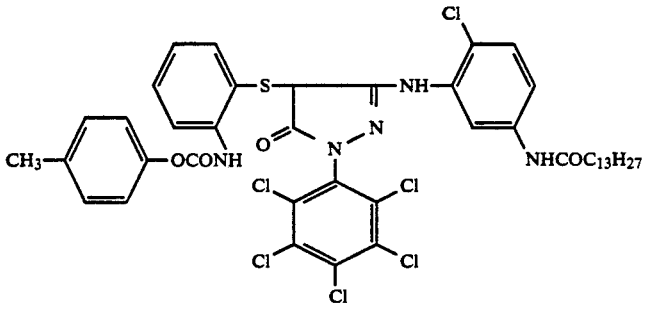
M-13
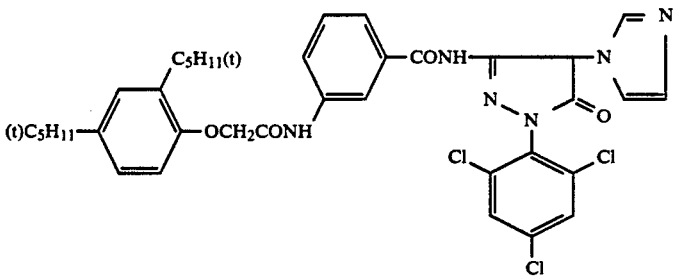
M-14
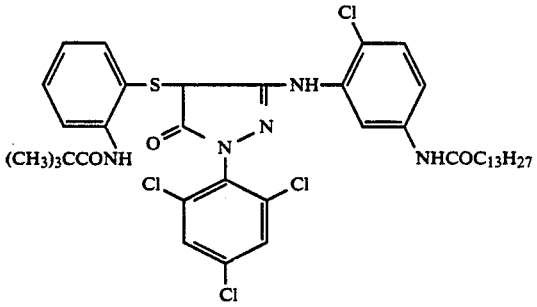
M-15
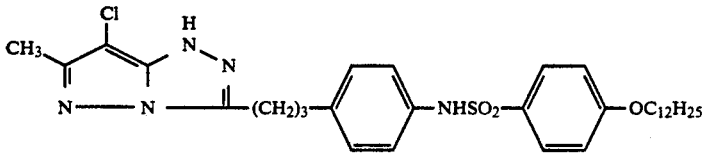
M-16
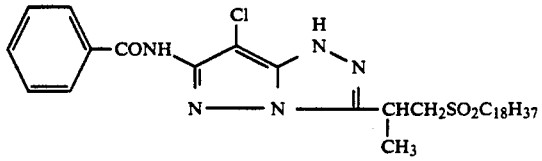

-continued
M-17
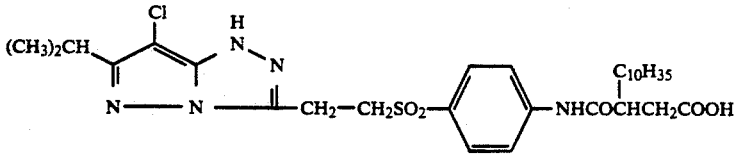
M-18
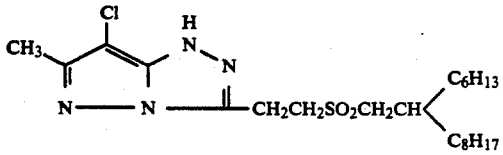
M-19
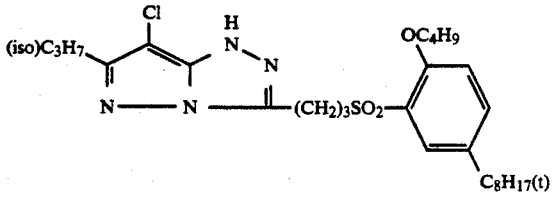
M-20
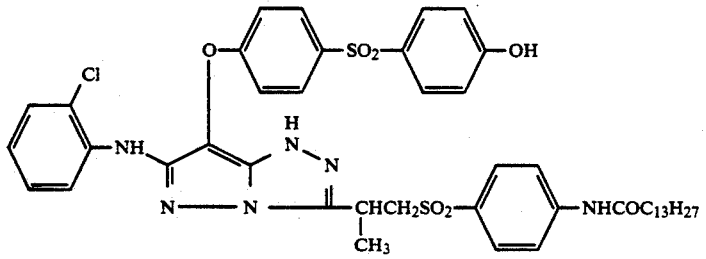
M-21
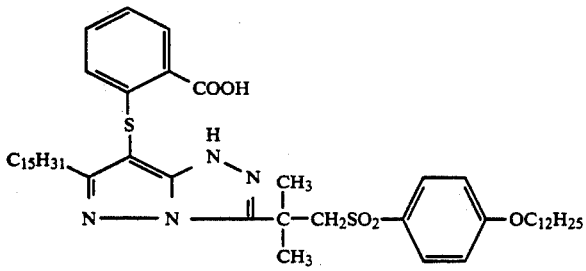
M-22
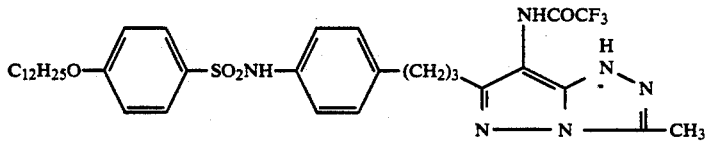
M-23
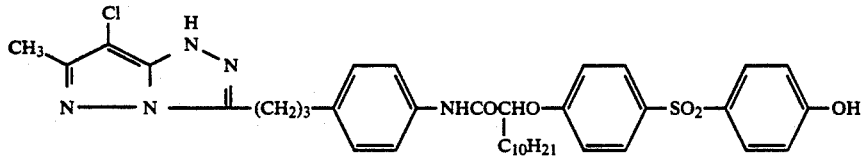
M-24
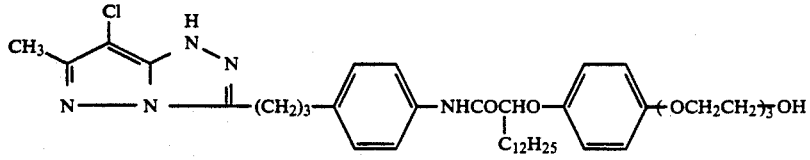

-continued
M-25
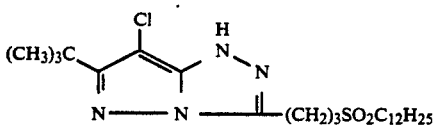
M-26
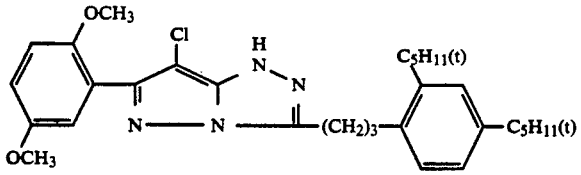
M-27
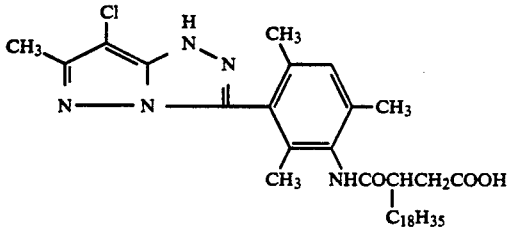
M-28
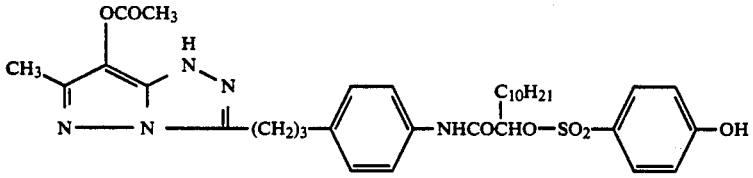
M-29
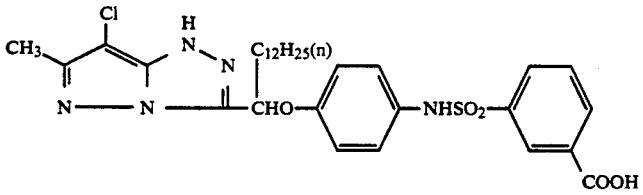
M-30
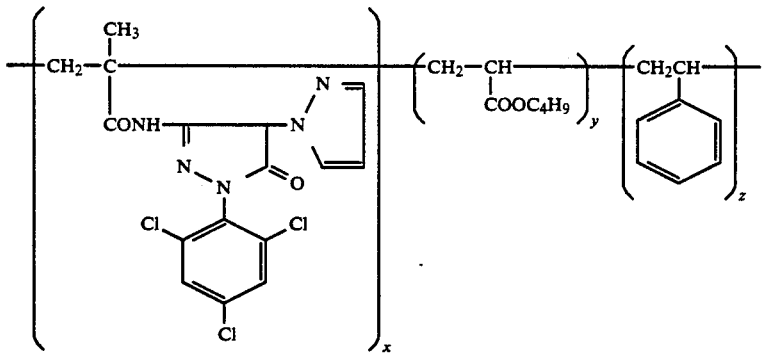
x:y:z: = 50:25:25 (weight ratio)
M-31
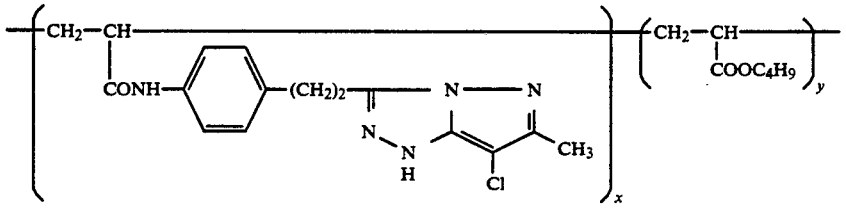
x:Y = 50:50 (weight ratio)

-continued
M-32
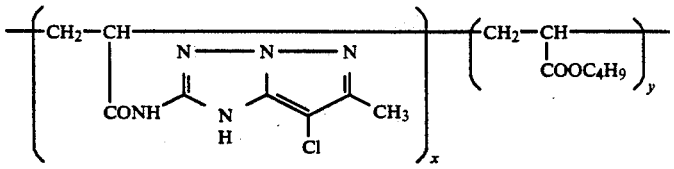
x:y: = 50:50 (weight ratio)
M-33
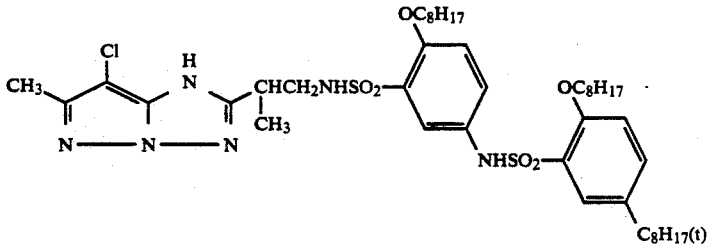
M-34
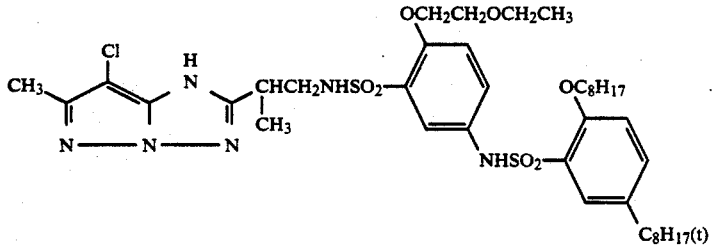
M-35
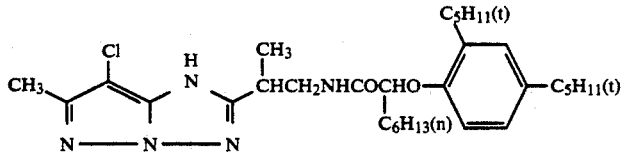
M-36
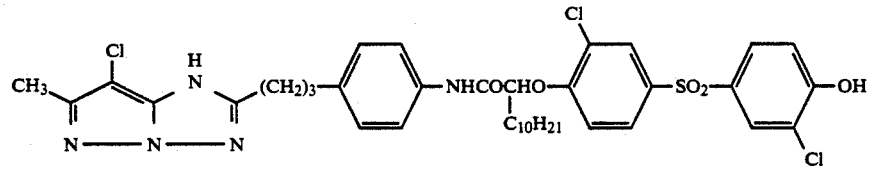
M-37
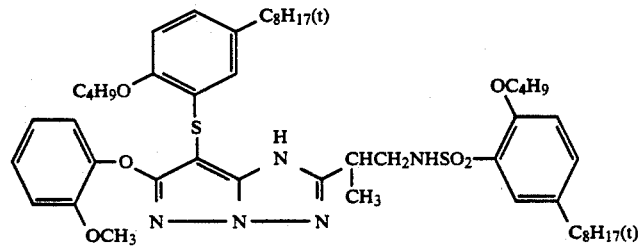
M-38
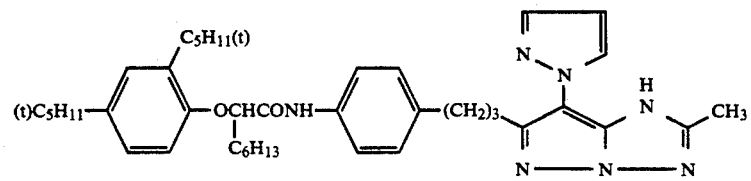

-continued
M-39
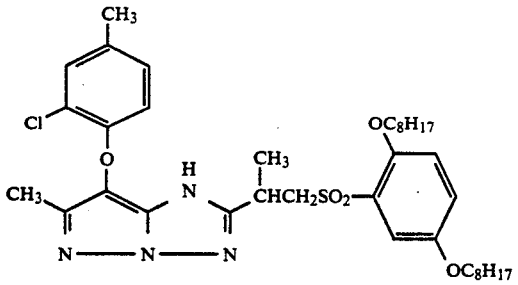
2-equivalent cyan couplers
C-1
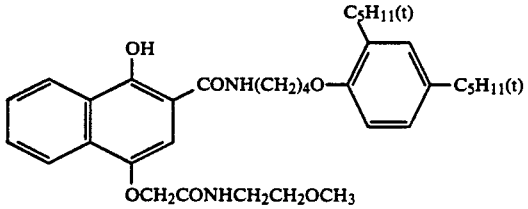
C-2
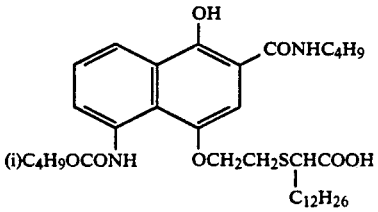
C-3
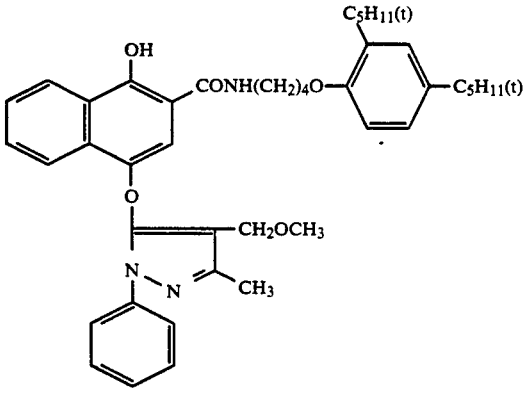
C-4
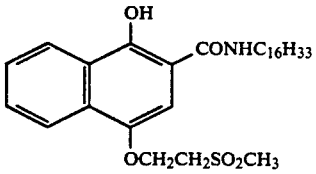
C-5
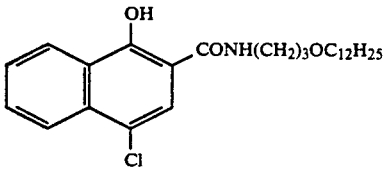

-continued
C-6
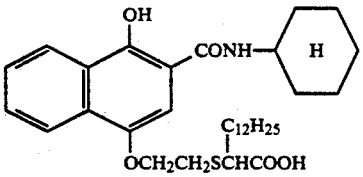
C-7
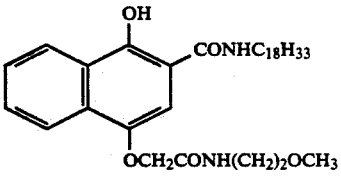
C-8
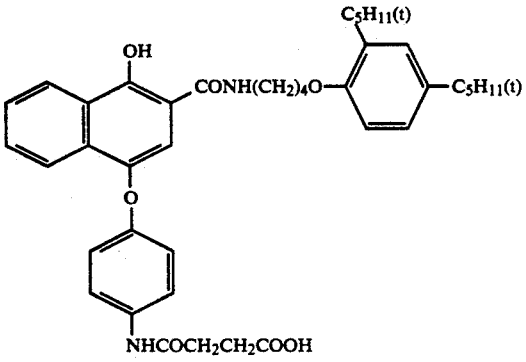
C-9
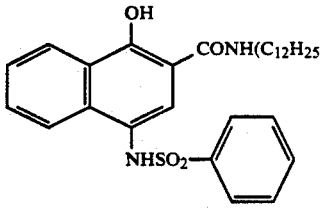
C-10
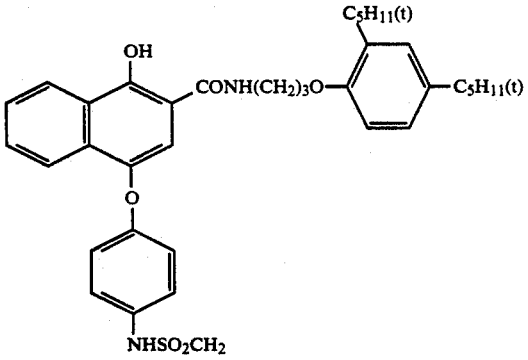
C-11
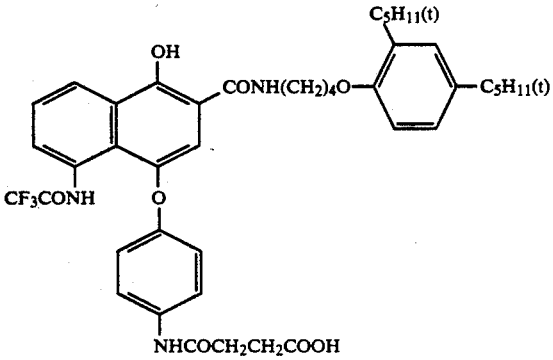

-continued
C-12
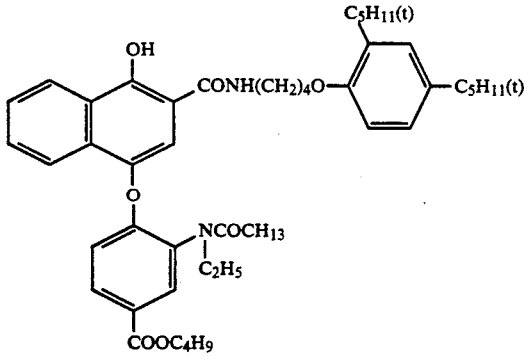
C-13
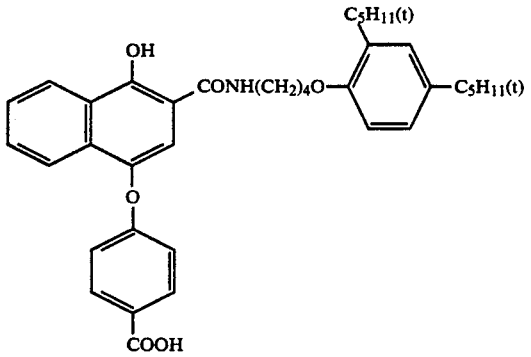
C-14
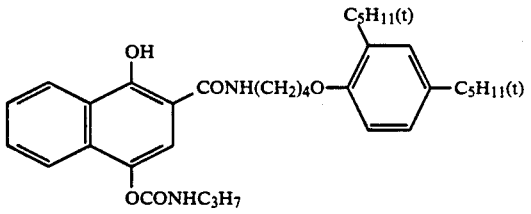
C-15
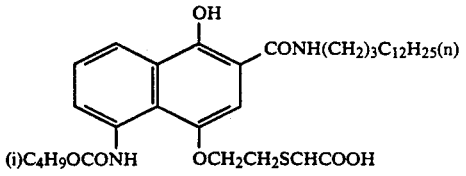
C-16
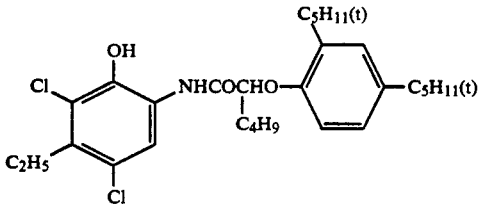
C-17
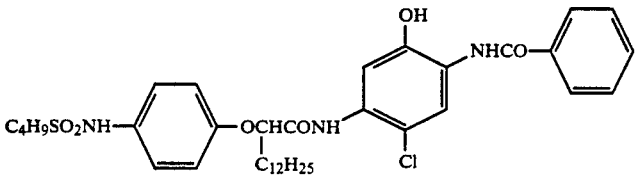

-continued
C-18
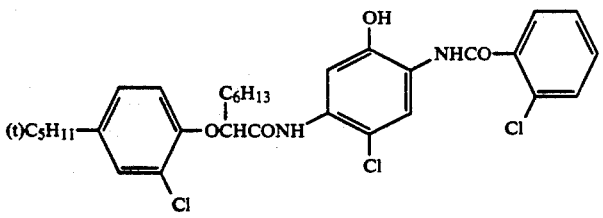
C-19
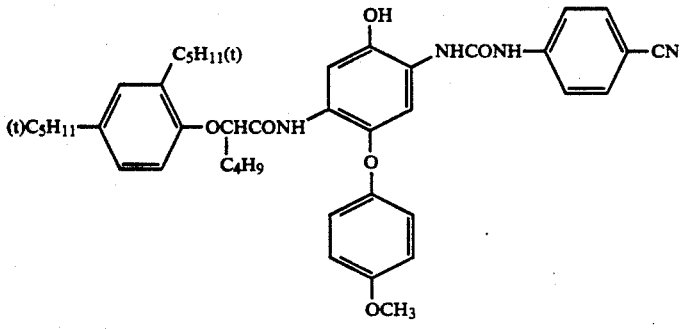
C-20
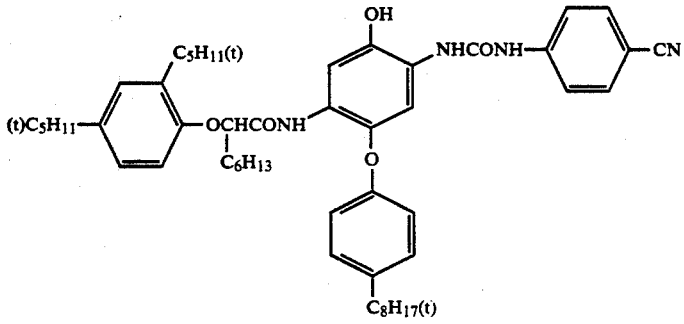
C-21
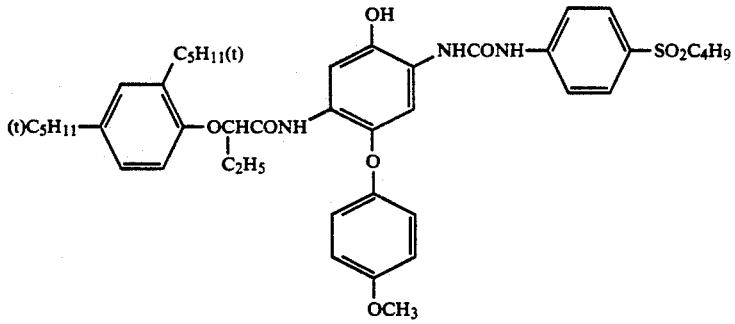
C-22
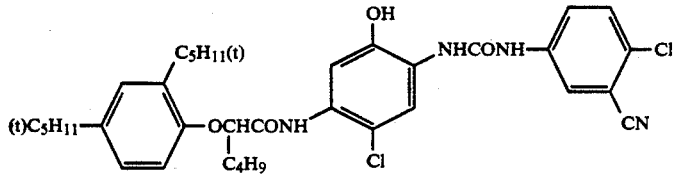
C-23
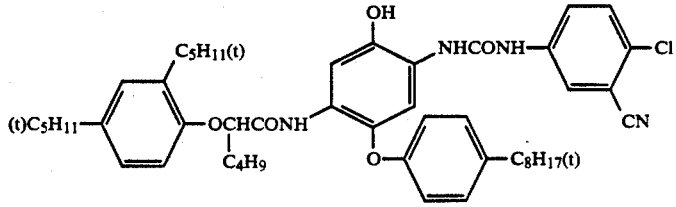

-continued
C-24
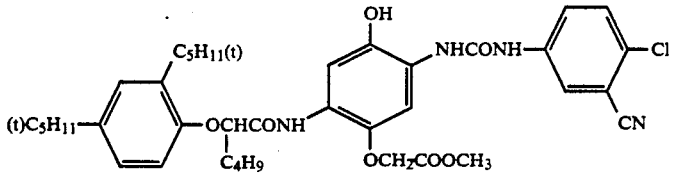
C-25
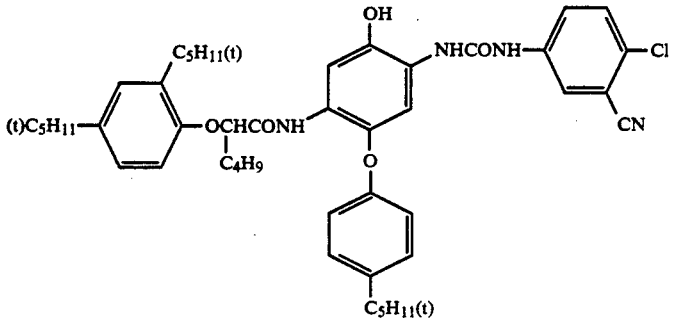
C-26
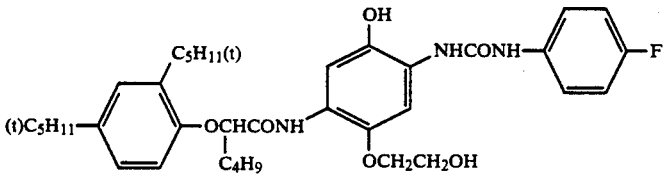
C-27
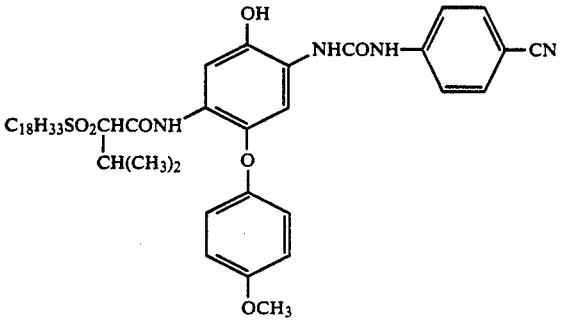
C-28
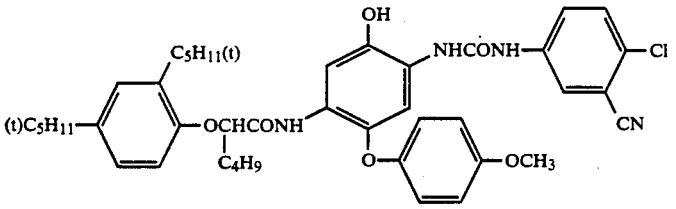
C-29
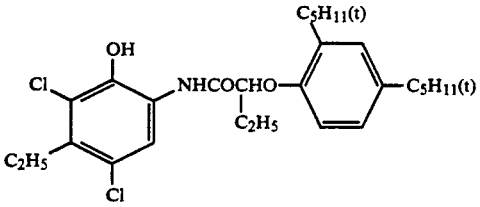
C-30
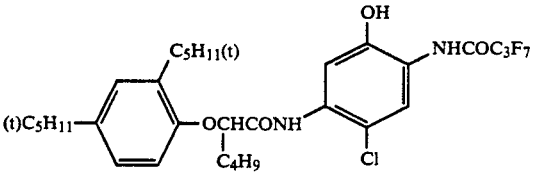

-continued
C-31
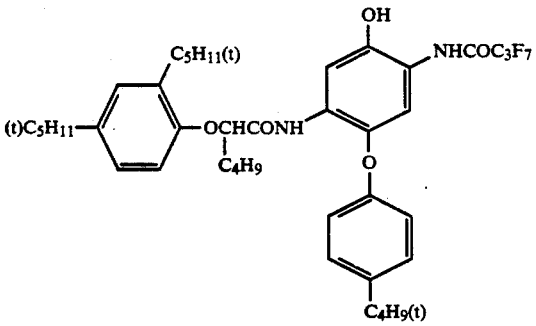
C-32
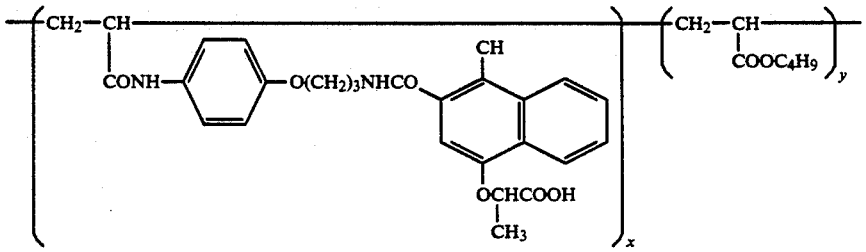
x:y: = 40:60 (weight ratio)
C-33
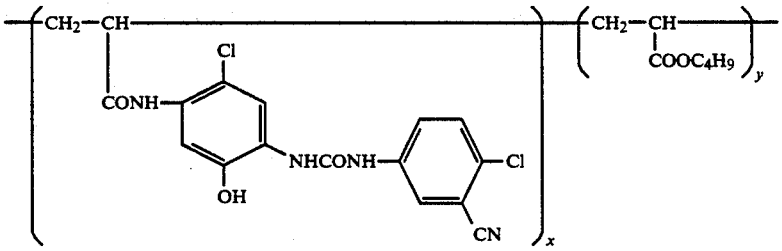
x:y: = 50:50 (weight ratio)
C-34
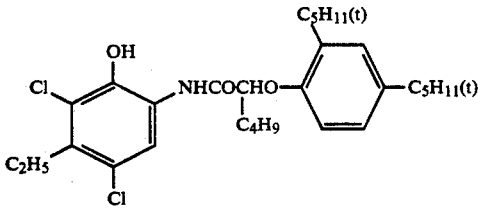
C-35
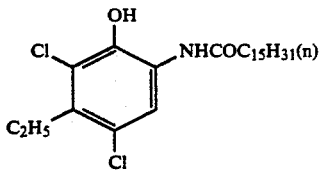
C-36
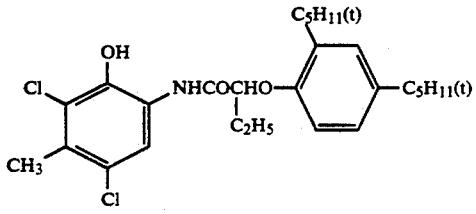

-continued

C-37

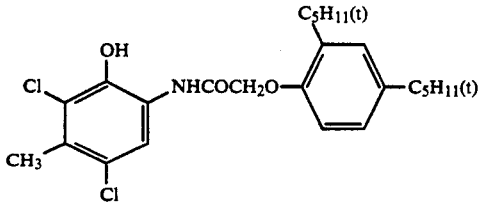

C-38

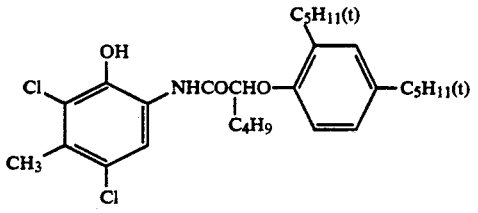

C-39

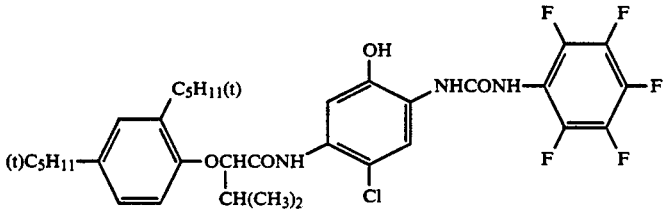

C-40

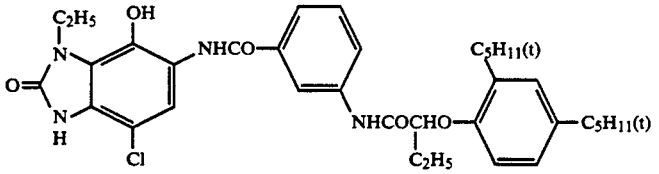

In the present invention, two or more yellow couplers may be used in combination. The total amount of their addition is preferably $5\times10^{-5}$ to $2\times10^{-3}$ mol/m$^2$, more preferably $1\times10^{-4}$ to $2\times10^{-3}$ mol/m$^2$, and ideally $2\times10^{-4}$ to $2\times10^{-3}$ mol/m$^2$. Two or more magenta couplers may be used in combination. The of their addition is preferably $2\times10^{-5}$ to $1\times10^{-3}$ mol/m$^2$, more preferably $5\times10^{-5}$ to $1\times10^{-3}$ mol/m$^2$, and ideally $1\times10^{-4}$ to $1\times10^{-3}$ mol/m$^2$. Two or more cyan couplers may be used in combination. The of their addition is preferably $5\times10^{-5}$ to $2\times10^{-3}$ mol/m$^2$, more preferably $1\times10^{-4}$ to $2\times10^{-3}$ mol/m$^2$, and ideally $2\times10^{-4}$ to $2\times10^{-3}$ mol/m$^2$.

In the present invention, the light-sensitive silver halide emulsion layer incorporates a 2-equivalent coupler, which may be used in combination with a 4-equivalent coupler. When using a 4-equivalent coupler, the 2-equivalent coupler content is preferably 50 to 100 mol % of the total coupler content, with the remaining part accounted for by the 4-equivalent coupler. It is more preferable that the 2-equivalent coupler account for 70 to 100 mol %, ideally 100 mol %, i.e., the total coupler content be accounted for by the 2-equivalent coupler.

Here, the 4-equivalent coupler is a coupler having no substituent at the coupling site. The yellow coupler is preferably an acylacetoanilide such as pivaloylacetoanilide or benzoylacetoanilide. The magenta coupler include indazolones, cyanoacetyls, 5-pyrazolones, and pyrazoloazoles such as pyrazoloimidazole and pyrazolotriazole, with preference given to 5-pyrazolones and pyrazoloazoles. The cyan coupler is preferably a phenol or naphthol.

Examples of 4-equivalent couplers which can be preferably used in combination include those represented by Formulae 2eq-2 through 2eq-10 wherein X at the coupling site is a hydrogen atom. Examples of $R_1$ through $R_4$ include those exemplified for Formulas 2eq-2 through 2eq-10, including the cases where $R_1$ through $R_4$ form a dimer or higher polymer.

In the present invention, various other couplers may be used in combination. Examples thereof are given in the following Research Disclosure Numbers.

The following table gives where relevant descriptions appear. The 4-equivalent couplers described in the Research Disclosure Numbers may be used in combination.

| Item | Page in RD308119 | RD17643/RD18716 |
|---|---|---|
| Yellow coupler | 1001, VII-Term D | VII-Terms C-G |
| Magenta coupler | 1001, VII-Term D | VII-Terms C-G |
| Cyan coupler | 1001, VII-Term D | VII-Terms C-G |
| Colored coupler | 1002, VII-Term G | VII-Term G |
| DIR coupler | 1001, VII-Term F | VII-Term F |
| BAR coupler | 1002, VII-Term F | |
| Other couplers which release a useful residue | 1001, VII-Term F | |
| Alkali-soluble coupler | 1001, VII-Term E | |

The additives used for the present invention can be added by dispersion as described in RD308119 XIV and by other methods.

In the present invention, the supports described in RD17643, p. 28, RD18716, pp. 647–648 and RD308119 XIX can be used.

The light-sensitive material for the present invention may be provided with auxiliary layers such as a filter layer and interlayer as described in RD308119, VII-Term K.

The light-sensitive material for the invention can take various layer configurations such as the ordinary, reverse and unit structures described in RD308119, VII-Term K.

When a vinyl sulfone hardener is used in the light-sensitive material, the effect of the present invention is enhanced.

The vinyl sulfone hardener is a compound having a vinyl group bound to a sulfonyl group or a group capable of forming a vinyl group, preferably having two or more vinyl groups bound to a sulfonyl group or two or more groups capable of forming a vinyl group.

The compound represented by Formula VS-I is preferably used for the present invention.

$$L-(SO_2-X)_m \qquad \text{Formula VS-I}$$

wherein L represents an m-valent bonding group; X represents $-CH=CH_2$ or $-CH_2CH_2Y$ wherein Y represents a group capable of splitting off in the form of HY upon reaction with base, such as a halogen atom, sulfonyloxy group, sulfoxy group (including its salt) or tertiary amine residue; m represents an integer of 2 to 10; when m is 2 or more, the $-SO_2-X$ groups may be identical or not.

The m-valent bonding group L is an m-valent group formed with one or more members selected from the group comprising aliphatic hydrocarbon groups such as alkylene, alkylidene, alkylidine and groups formed therewith, aromatic hydrocarbon groups such as arylene and groups formed therewith, —O—, —NR'— (R' represents a hydrogen atom or an alkyl group having preferably 1 to 15 carbon atoms), —S—, $$-\underset{|}{N}-,$$

—CO, —SO—, $-SO_2-$ or $-SO_3-$; when two or more —NR'— groups are present, the R' groups therein may bind together to form a ring.

The bonding group L includes those having a substituent such as a hydroxyl group, alkoxy group, carbamoyl group, sulfamoyl group, alkyl group or aryl group.

X is preferably $-CH_2=CH_2$ or $-CH_2CH_2Cl$.

Examples of vinyl sulfone hardeners are given below.

$H_2C=CHSO_2CH_2SO_2CH=CH_2$ VS-1

$H_2C=CHSO_2(CH_2)_2SO_2CH=CH_2$ VS-2

$H_2C=CHSO_2(CH_2)_2SO_2CH=CH_2$ VS-3

$H_2C=CHSO_2CH_2CH_2OCH_2SO_2CH=CH_2$ VS-4

$H_2C=CHSO_2(CH_2)_2O(CH_2)_2SO_2CH=CH_2$ VS-5

$H_2C=CHSO_2CH_2\underset{\underset{OH}{|}}{C}HCH_2SO_2CH=CH_2$ VS-6

$H_2C=CHSO_2CH_2\underset{\underset{OH}{|}}{C}HCH_2\underset{\underset{OH}{|}}{C}HCH_2SO_2CH=CH_2$ VS-7

$H_2C=CHSO_2CH_2CONHCH_2NHCOCH_2SO_2CH=CH_2$ VS-8

$H_2C=CHSO_2CH_2CONH(CH_2)_2NHCOCH_2SO_2CH=CH_2$ VS-9

$H_2C=CHSO_2CH_2CONHCH_2CH_2CH_2NHCOCH_2SO_2CH=CH_2$ VS-10

VS-11

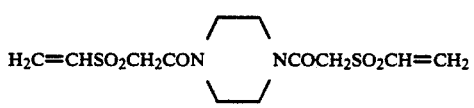

VS-12

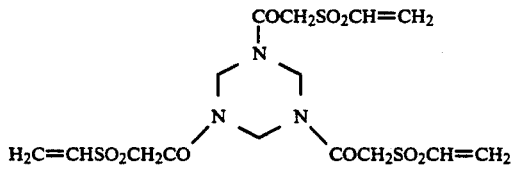

VS-13

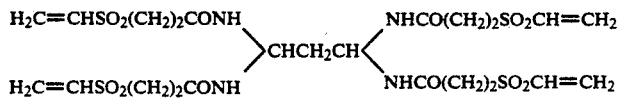

VS-14

$H_2C=CHSO_2(CH_2)_2CONH-CH_2$
$H_2C=CHSO_2(CH_2)_2CONH-CH_2$

-continued
VS-15
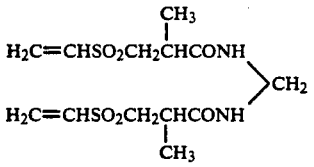
VS-16
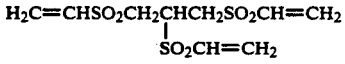
VS-17
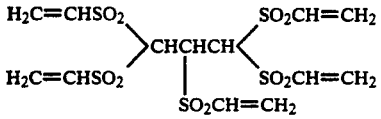
VS-18
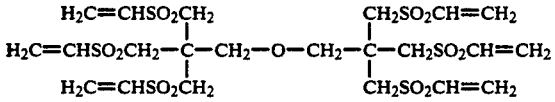
VS-19
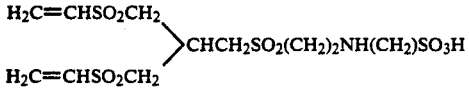
VS-20
$[(CH_2{=}CHSO_2)_3CCH_2SO_2(CH_2)_2SCH_2]_2CO$
VS-21
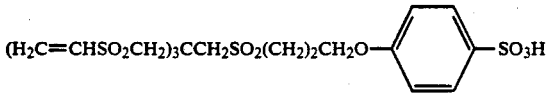
VS-22
$(H_2C{=}CHSO_2CH_2)_4C$
VS-23
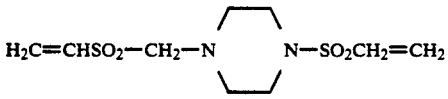
VS-24
$(H_2C{=}CHSO_2CH_2)_3CC_2H_5$
VS-25
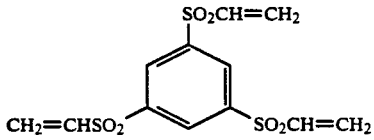
VS-26
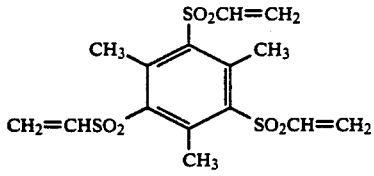
VS-27
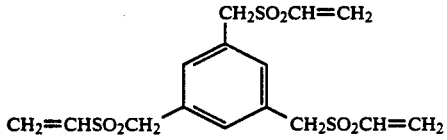
VS-28
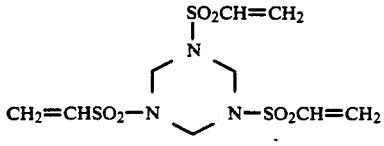

-continued

VS-29

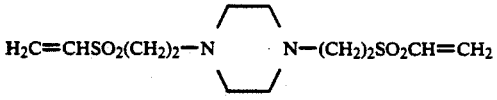

$H_2C{=}CHSO_2(CH_2)_2{-}N$ $N{-}(CH_2)_2SO_2CH{=}CH_2$

VS-30

$H_2C{=}CHSO_2(CH_2)_2SO_2(CH_2)_2SO_2CH{=}CH_2$

VS-31

$H_2C{=}CHSO_2(CH_2)_2O(CH_2)_2NHONH(CH_2)_2O(CH_2)_2SO_2CH{=}CH_2$

VS-32

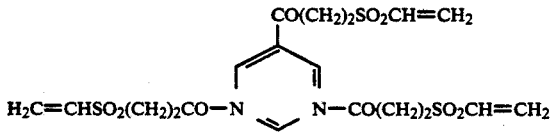

$CO(CH_2)_2SO_2CH{=}CH_2$ $H_2C{=}CHSO_2(CH_2)_2CO{-}N$ $N{-}CO(CH_2)_2SO_2CH{=}CH_2$

VS-33

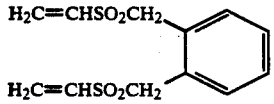

$H_2C{=}CHSO_2CH_2$ $H_2C{=}CHSO_2CH_2$

VS-34

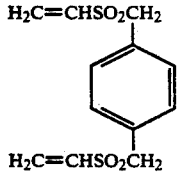

$H_2C{=}CHSO_2CH_2$ $H_2C{=}CHSO_2CH_2$

VS-35

$(H_2C{=}CHSO_2NH)_2CH_2$

VS-36

$H_2C{=}CHSO_2(CH_2)_2NH(CH_2)_2NH(CH_2)_2SO_2CH{=}CH_2$

VS-37

$(H_2C{=}CHSO_2(CH_2)_2CON(CH_3)CH_2)_2CH_2$

VS-38

$Cl(CH_2)_2SO_2CH(C_2H_5)COO(CH_2)_2OCOCH(C_2H_5)SO_2(CH_2)_2Cl$

VS-39

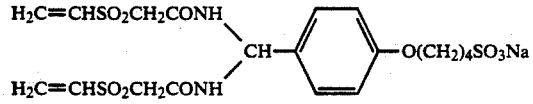

$H_2C{=}CHSO_2CH_2CONH$ $CH{-}$ $-O(CH_2)_4SO_3Na$ $H_2C{=}CHSO_2CH_2CONH$

VS-40

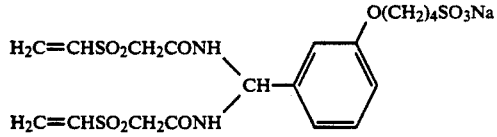

$O(CH_2)_4SO_3Na$ $H_2C{=}CHSO_2CH_2CONH$ $CH{-}$ $H_2C{=}CHSO_2CH_2CONH$

VS-41

$C_8H_17C(CHSO_2CH{=}CH_2)_3$

VS-42

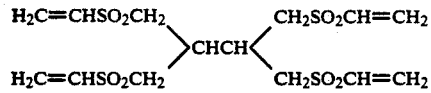

$H_2C{=}CHSO_2CH_2$ $CH_2SO_2CH{=}CH_2$ $CHCH$ $H_2C{=}CHSO_2CH_2$ $CH_2SO_2CH{=}CH_2$

VS-43

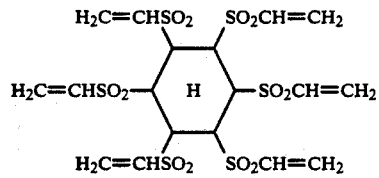

$H_2C{=}CHSO_2$ $SO_2CH{=}CH_2$ $H_2C{=}CHSO_2{-}$ H $-SO_2CH{=}CH_2$ $H_2C{=}CHSO_2$ $SO_2CH{=}CH_2$

VS-44

$CH_2(CONHCH_2SO_2CH{=}CH_2)_2$

VS-45

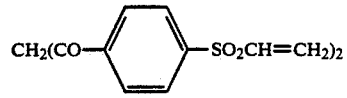

$CH_2(CO{-}$ $-SO_2CH{=}CH_2)_2$

-continued $C[CO(CH_2)_2SO_2CH{=}CH_2]_4$ VS-46

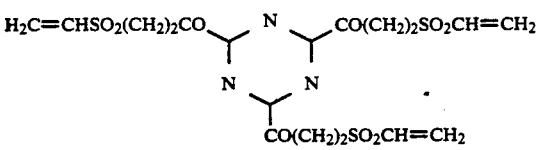
VS-47

$NH[(CH_2)_2SO_2CH{=}CH_2]_2$ VS-48

$CH_3C(CH_2OCH_2SO_2CH{=}CH_2)_3$ VS-49

$C(CH_2OCH_2SO_2CH{=}CH_2)_4$ VS-50

$N[(CH_2)_2OCH_2SO_2CH{=}CH_2]_3$ VS-51

$(CH_2{=}CHSO_2CH_2)_3CCHSO_2(CH_2)_2Cl$ VS-52

$H_2C{=}CHSO_2CH{=}CH_2$ VS-53

$H_2C{=}CHSO_2CH_2(CH_2SO_2CH_2CH_2OSO_3^{\ominus}Na^{\oplus})_3$ VS-54

$CH_3SO_3(CH_2)_2SO_2(CH_2)_2OSO_2CH_3$ VS-55

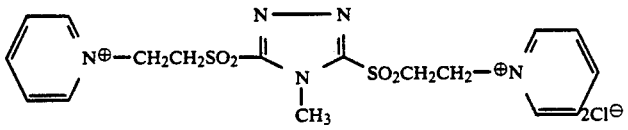
VS-56

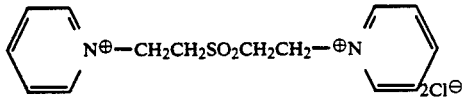
VS-57

Examples of the vinyl sulfone hardener for the present invention include the aromatic compounds described in German Patent No. 1,100,942 and U.S. Pat. No. 3,490,911, the alkyl compounds bound via hetero atom described in Japanese Patent Examined Publication Nos. 29622/1969, 25373/1972 and 24259/1972, the sulfonamide ester compounds described in Japanese Patent Examined Publication No. 8736/1972, the 1,3,5-tris[β-(vinylsulfonyl)propionyl]-hexahydro-s-triazine described in Japanese Patent O.P.I. Publication No. 24435/1974 and the alkyl compounds described in Japanese Patent Examined Publication No. 35807/1975 and Japanese Patent O.P.I. Publication No. 44164/1976 and the compounds described in Japanese Patent O.P.I. Publication No. 18944/1984.

These vinyl sulfone hardeners are used in solution in water or organic solvent in a ratio of 0.005 to 20% by weight, preferably 0.02 to 10% by weight of binder such as gelatin. Their addition to the photographic layer is achieved by the batch method or in-line addition method, for instance.

The layers to add these hardeners thereto are not subject to limitation; for example, the hardeners may be added to the uppermost layer alone, the lowermost layer alone or all layers.

In the present invention, the silver halide color photographic light-sensitive material preferably contains a compound represented by one of Formulae B-1 through B-3.

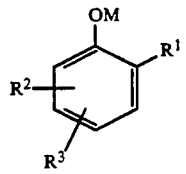
Formula B-1 wherein $R^1$ represents an alkyl group, cycloalkyl group, aryl group, hydroxyl group, alkoxycarbonyl group, amino group, carboxylic acid group (including its salt) or sulfonic acid group (including its salt). $R^2$ and $R^3$ independently represent a hydrogen atom, halogen atom, amino group, nitro group, hydroxyl group, alkoxycarbonyl group, carboxylic acid group (including its salt) or sulfonic acid group (including its salt). M represents a hydrogen atom, alkali metal or ammonium group.

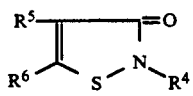
Formula B-2

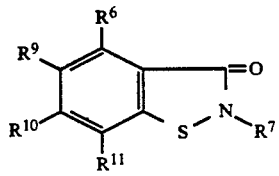
Formula B-3 wherein $R^4$ represents a hydrogen atom, halogen atom, alkyl group, aryl group, halogenated alkyl group, $—R^1$-

2—$OR^{13}$, —$CONHR^{14}$ ($R^{12}$ represents an alkylene group; $R^{13}$ and $R^{14}$ independently represent a hydrogen atom, alkyl group or arylalkyl group) or arylalkyl group; $R^5$ and $R^6$ independently represent a hydrogen atom, halogen atom, halogenated alkyl group or alkyl group; $R^7$ represents a hydrogen atom, halogen atom, alkyl group, aryl group, halogenated alkyl group, arylalkyl group, —$R^{15}$—$R^{16}$ or —$CONHR^{17}$ ($R^{15}$ represents an alkylene group; $R^{16}$ and $R^{17}$ independently represent a hydrogen atom or alkyl group); $R^8$, $R^9$, $R^{10}$ and $R^{11}$ independently represent a hydrogen atom, halogen atom, hydroxyl group, alkyl group, amino group or nitro group.

The compound represented by Formula B-1 is exemplified as follows.

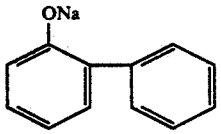

(B-1-1)

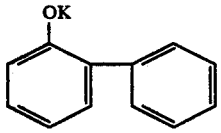

(B-1-2)

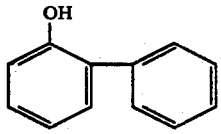

(B-1-3)

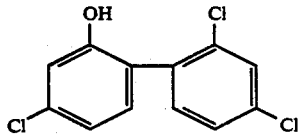

(B-1-4)

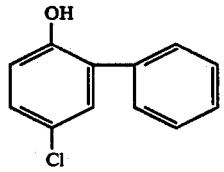

(B-1-5)

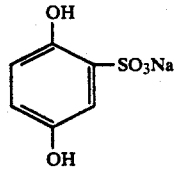

(B-1-6)

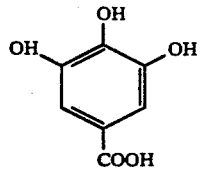

(B-1-7)

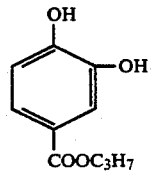

(B-1-8)

-continued

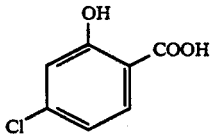

(B-1-9)

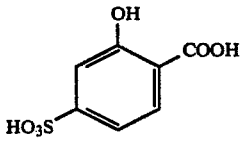

(B-1-10)

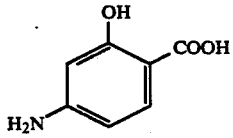

(B-1-11)

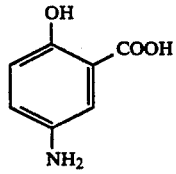

(B-1-12)

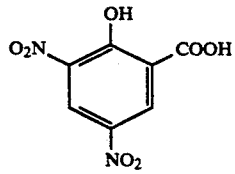

(B-1-13)

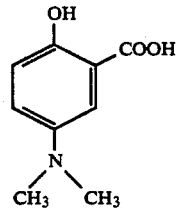

(B-1-14)

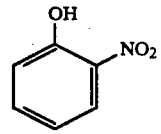

(B-1-15)

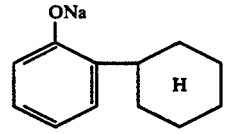

(B-1-16)

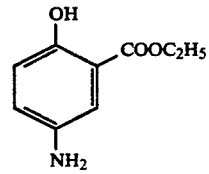

(B-1-17)

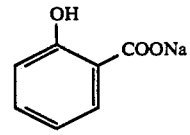

(B-1-18)

-continued

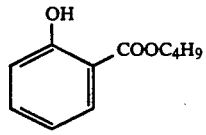

(B-1-19)

The compound represented by Formula B-1 is commercially available and is easily available by those skilled in the art.

Of the compounds exemplified above, Compound Nos. B-1-1, B-1-2, B-1-3, B-1-4 and B-1-5 are preferable.

The compound of Formula B-1 for the present invention may be used in combination of two or more kinds. It is preferable to use it in a of 0.03 to 50 g, more preferably 0.12 to 10 g, and still more preferably 0.15 to 5 g per liter of the stabilizer for the invention.

Examples of the compounds represented by Formulae B-2 and B-3 are given below.

B-2-1: 2-methyl-4-isothiazolin-3-one
B-2-2: 5-chloro-2-methyl-4-isothiazolin-3-one
B-2-3: 2-methyl-5-phenyl-4-isothiazolin-3-one
B-2-4: 4-bromo-5-chloro-2-methyl-4-isothiazolin 3 one
B-2-5: 2-hydroxymethyl-4-isothiazolin-3-one
B-2-6: 2-(ethoxyethyl)-4-isothiazolin-3-one
B-2-7: 2-(N-methyl-carbamoyl)-4-isothiazolin-3-one
B-2-8: 5-bromomethyl-2-(N-dichlorophenyl-carbamoyl)-4-isothiazolin-3-one
B-2-9: 5-chloro-2-(2-phenylethyl)-4-isothiazolin-3-one
B-2-10: 4-methyl-2-(3,4-dichlorophenyl)-4-isothiazolin-3-one
B-3-1: 1,2-benzisothiazolin-3-one
B-3-2: 2-(2-bromoethyl)-1,2-benzisothiazolin-3-one
B-3-3: 2-methyl-1,2-benzisothiazolin-3-one
B-3-4: 2-ethyl-5-nitro-1,2-benzisothiazolin-3-one
B-3-5: 2-benzyl-1,2-benzisothiazolin-3-one
B-3-6: 5-chloro-1,2-benzisothiazolin-3-one With respect to these exemplified compounds, methods of synthesis and example applications to other fields are described in U.S. Pat. Nos. 2,767,172, 2,767,173, 2,767,174 and 2,870,015, British Patent No. 848,130, French Patent No. 1,555,416 and other publications. Some of them are commercially available under trade names Topcide 300 and Topcide 600 (both produced by Permachem Asia), Finecide J-700 (produced by Tokyo Fine Chemical) and Proxel GXL (produced by I.C.I.).

The compounds represented by Formulae B-1 through B-3 are used in a of 0.1 to 500 mg, preferably 0.5 to 100 mg per $m^2$ of light-sensitive material, and may be used in combination of two or more kinds.

The present invention is applicable to color photographic light-sensitive materials such as color printing paper, color negative film, color reversal film, color reversal paper, direct positive color printing paper, color film for movie and color film for TV for ordinary or movie use.

EXAMPLES

The present invention is hereinafter described in more detail by means of the following examples, but the mode of embodiment of the invention is not limited by these examples.

Example 1

The following layers with the compositions shown below were sequentially formed on a triacetyl cellulose film support in the order from the support side to yield a multiple layered color photographic light-sensitive material sample No. 1.

The amount of addition in silver halide photographic light-sensitive material is expressed in gram per $m^2$, unless otherwise stated. The figures for silver halide and colloidal silver have been converted to the amounts of silver. Figures for the amount of sensitizing dyes are shown in mol per mol of silver in the same layer.

| Sample No. 1 | |
|---|---|
| Layer 1: Anti-halation layer | |
| Black colloidal silver | 0.2 |
| UV absorbent UV-1 | 0.23 |
| High boiling solvent Oil-1 | 0.18 |
| Gelatin | 1.4 |
| Layer 2: First interlayer | |
| Gelatin | 1.3 |
| Layer 3: Low speed red-sensitive emulsion layer | |
| Silver iodobromide emulsion (average grain size 0.4 μm, AgI content 2.0 mol %) | 1.0 |
| Sensitizing dye SD-1 | $1.8 \times 10^{-5}$ |
| Sensitizing dye SD-2 | $2.8 \times 10^{-4}$ |
| Sensitizing dye SD-3 | $3.0 \times 10^{-4}$ |
| Cyan coupler CCp-1 | 1.13 × 10-3 mol/m2 |
| Colored cyan coupler CC-1 | 0.066 |
| DIR compound D-1 | 0.03 |
| DIR compound D-3 | 0.01 |
| High boiling solvent Oil-1 | 0.64 |
| Gelatin | 1.2 |
| Layer 4: Moderate speed red-sensitive emulsion layer | |
| Silver iodobromide emulsion (average grain size 0.7 μm, AgI content 8.0 mol %, comprising AgBrI having an average grain size r of 0.5 μm and an AgI content of 7.0 mol %) | 0.8 |
| Sensitizing dye SD-1 | $2.1 \times 10^{-5}$ |
| Sensitizing dye SD-2 | $1.9 \times 10^{-4}$ |
| Sensitizing dye SD-3 | $1.9 \times 10^{-4}$ |
| Cyan coupler CCp-1 | 4.53 × 10-3 mol/$m^2$ |
| Colored cyan coupler CC-1 | 0.027 |
| DIR compound D-1 | 0.01 |
| High boiling solvent Oil-1 | 0.26 |
| Gelatin | 0.6 |
| Layer 5: High speed red-sensitive emulsion layer | |
| Silver iodobromide emulsion (average grain size 0.8 μm, AgI content 8.0 mol %) | 1.70 |
| Sensitizing dye SD-1 | $1.9 \times 10^{-5}$ |
| Sensitizing dye SD-2 | $1.7 \times 10^{-4}$ |
| Sensitizing dye SD-3 | $1.7 \times 10^{-4}$ |
| Cyan coupler CCp-1 | $8.1 \times 10^{-5}$ mol/$m^2$ |
| Cyan coupler CCp-2 | $3.04 \times 10^{-4}$ mol/$m^2$ |
| Colored cyan coupler CC-1 | 0.02 |
| DIR compound D-1 | 0.025 |
| High boiling solvent Oil-1 | 0.21 |
| Gelatin | 1.2 |
| Layer 6: Second interlayer | |
| Gelatin | 0.8 |
| Layer 7: Low speed green-sensitive emulsion layer | |
| Silver iodobromide emulsion (average grain size 0.4 μm, AgI content 2.0 mol %) | 1.1 |
| Sensitizing dye SD-4 | $6.8 \times 10^{-5}$ |
| Sensitizing dye SD-5 | $6.2 \times 10^{-4}$ |
| Magenta coupler MCp-1 | $7.49 \times 10^{-4}$ mol/$m^2$ |
| Magenta coupler MCp-2 | $2.83 \times 10^{-4}$ mol/$m^2$ |
| Colored magenta coupler CM-1 | 0.06 |
| DIR compound D-2 | 0.017 |
| DIR compound D-3 | 0.01 |
| High boiling solvent Oil-2 | 0.81 |
| Gelatin | 1.8 |
| Layer 8: Moderate speed green-sensitive emulsion layer | |
| Silver iodobromide emulsion (average grain size 0.7 μm, AgI content 8.0 mol %) | 0.7 |
| Sensitizing dye SD-6 | $1.9 \times 10^{-4}$ |
| Sensitizing dye SD-7 | $1.2 \times 10^{-4}$ |
| Sensitizing dye SD-8 | $1.5 \times 10^{-5}$ |

-continued

| Sample No. 1 | |
|---|---|
| Magenta coupler MCp-1 | $9.7 \times 10^{-5}$ mol/m$^2$ |
| Magenta coupler MCp-2 | $4.5 \times 10^{-5}$ mol/m$^2$ |
| Colored magent coupler CM-1 | 0.04 |
| DIR compound D-2 | 0.018 |
| High boiling solvent Oil-2 | 0.30 |
| Gelatin | 0.8 |
| Layer 9: High speed green-sensitive emulsion layer | |
| Silver iodobromide emulsion (average grain size 1.0 μm, AgI content 8.0 mol %) | 1.7 |
| Sensitizing dye SD-6 | $1.2 \times 10^{-4}$ |
| Sensitizing dye SD-7 | $1.0 \times 10^{-4}$ |
| Sensitizing dye SD-8 | $3.4 \times 10^{-6}$ |
| Magenta coupler MCp-1 | $1.25 \times 10^{-4}$ mol/m$^2$ |
| Magenta coupler MCp-3 | $5.5 \times 10^{-5}$ mol/m$^2$ |
| Colored magenta coupler CM-1 | 0.04 |
| High boiling solvent Oil-2 | 0.31 |
| Gelatin | 1.2 |
| Layer 10: Yellow filter layer | |
| Yellow colloidal silver | 0.05 |
| Antistaining agent SC-1 | 0.1 |
| High boiling solvent Oil-2 | 0.13 |
| Gelatin | 0.7 |
| Formalin scavenger HS-1 | 0.09 |
| Formalin scavenger HS-2 | 0.07 |
| Layer 11: Low speed blue-sensitive emulsion layer | |
| Silver iodobromide emulsion having an average grain size of 0.4 μm and an AgI content of 2.0 mol % and silver iodobromide emulsion having an average grain size of 0.7 μm and an AgI content of 8.0 mol % | 0.5 |
| Sensitizing dye SD-9 | $5.2 \times 10^{-4}$ |
| Sensitizing dye SD-10 | $1.9 \times 10^{-5}$ |
| Yellow coupler YCp-1 | $1.55 \times 10^{-3}$ mol/m$^2$ |
| Yellow coupler YCp-1 | $6.88 \times 10^{-4}$ mol/m$^2$ |
| DIR compound D-1 | 0.03 |
| High boiling solvent Oil-2 | 0.24 |
| Gelatin | 1.3 |
| Formalin scavenger HS-1 | 0.08 |
| Layer 12: High speed blue-sensitive emulsion layer | |
| Silver iodobromide emulsion (average grain size 1.0 μm, AgI content 8.0 mol %) | 1.0 |

-continued

| Sample No. 1 | |
|---|---|
| Sensitizing dye SD-9 | $1.8 \times 10^{-4}$ |
| Sensitizing dye SD-10 | $7.9 \times 10^{-5}$ |
| Yellow coupler YCp-1 | $3.59 \times 10^{-4}$ mol/m$^2$ |
| Yellow coupler YCp-2 | $1.43 \times 10^{-4}$ mol/m$^2$ |
| High boiling solvent Oil-2 | 0.099 |
| Gelatin | 1.30 |
| Formalin scavenger HS-1 | 0.05 |
| Formalin scavenger HS-2 | 0.12 |
| Layer 13: First protective layer | |
| Fine grains of silver iodobromide emulsion (average grain size 0.08 μm, AgI content 1 mol %) | 0.4 |
| UV absorbent UV-1 | 0.07 |
| UV absorbent UV-2 | 0.10 |
| High boiling solvent Oil-1 | 0.07 |
| High boiling solvent Oil-3 | 0.07 |
| Formalin scavenger HS-1 | 0.13 |
| Formalin scavenger HS-2 | 0.37 |
| Gelatin | 1.3 |
| Layer 14: Second protective layer | |
| Alkali-soluble matting agent (average grain size 2 μm) | 0.13 |
| Polymethyl methacrylate (average grain size 3 μm) | 0.02 |
| Lubricant WAX-1 | 0.04 |
| Gelatin | 0.6 |

In addition to these compositions, a coating aid Su-1, a dispersing agent Su-2, a viscosity controlling agent, hardeners H-1 and H-2, a stabilizer ST-1, an antifogging agent AF-1 and two kinds of antifogging agent AF-2 having average molecular weights of 10000 and 1100000, respectively, were added to appropriate layers.

The emulsions used to prepare the sample were all monodispersed emulsions having a lower value for surface silver iodide content, which were subjected to optimum sensitization with gold and sulfur in accordance with a conventional method. Average grain size was calculated by converting the projected image to a circle image within the same area.

CCp-1

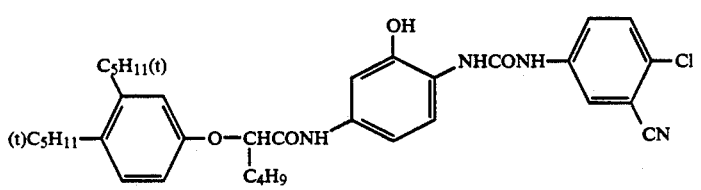

CCp-2

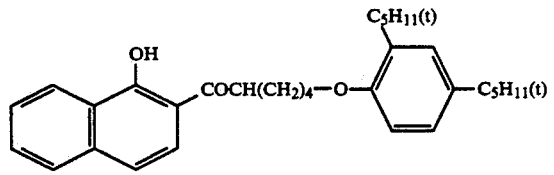

MCp-1

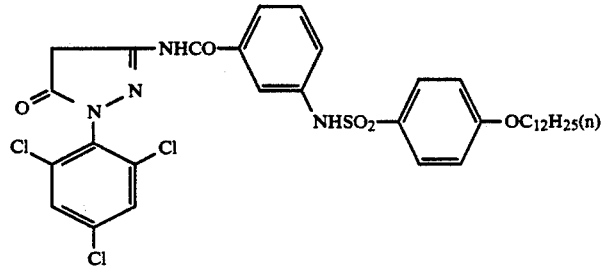

-continued
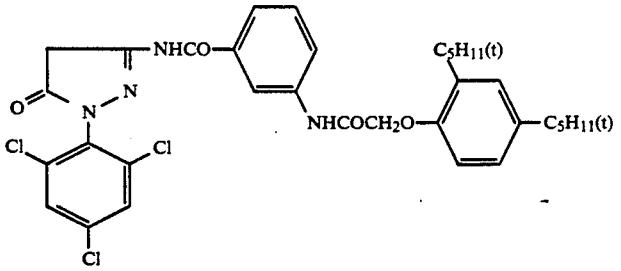
MCp-2
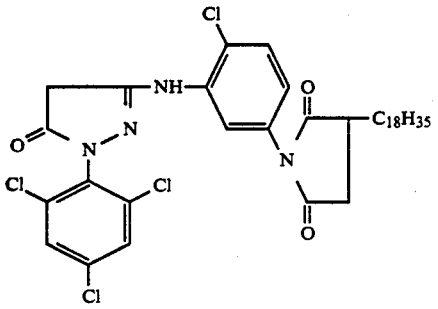
MCp-3
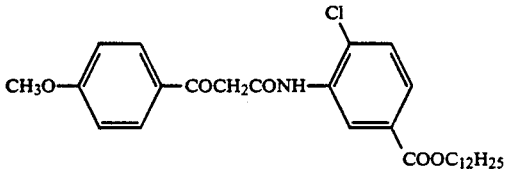
YCp-1
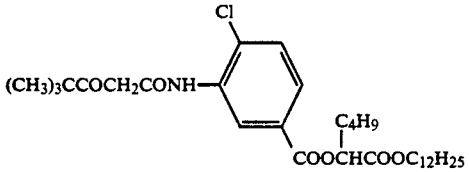
YCp-2
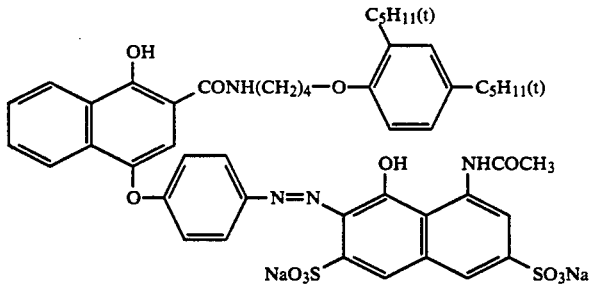
CC-1
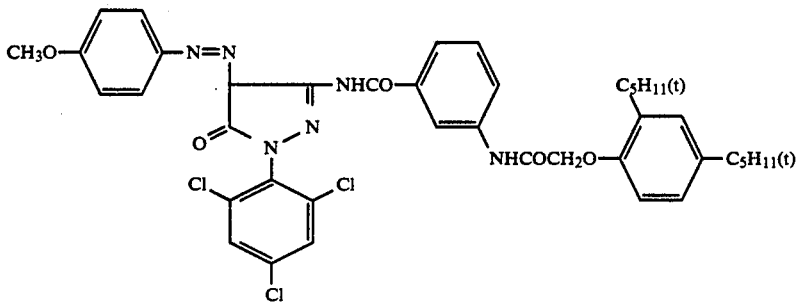
CM-1

-continued
D-1
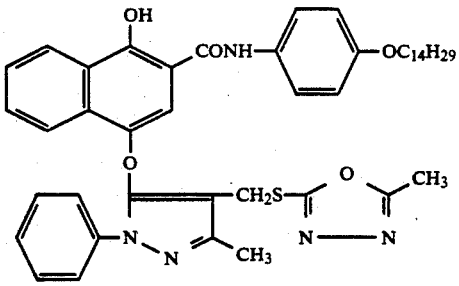
D-2
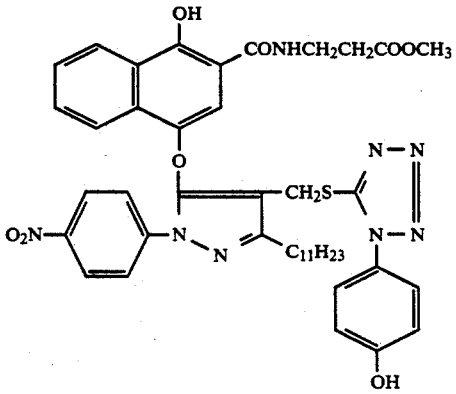
D-3
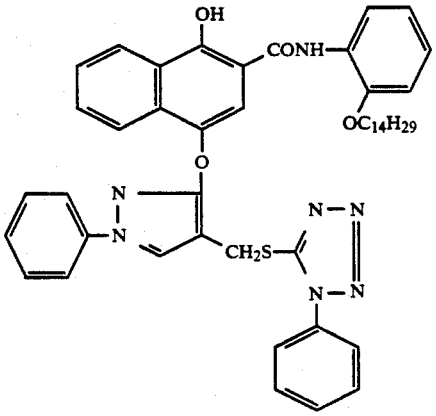
Oil-1
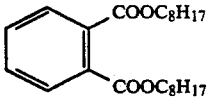
Oil-2
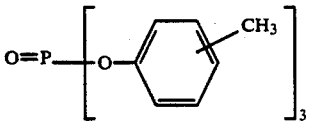
Oil-3
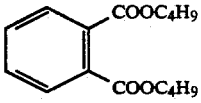
SC-1
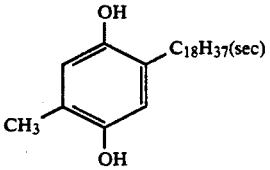

-continued
UV-1
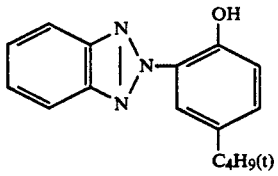
UV-2
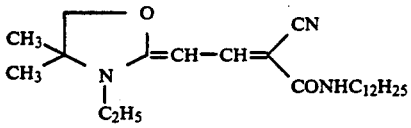
WAX-1
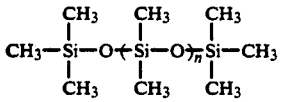
Weight average molecular weight MW = 3,000
Su-1
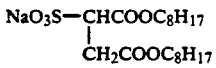
Su-2
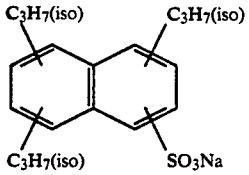
HS-1
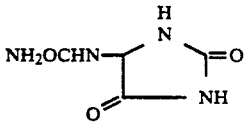
HS-2
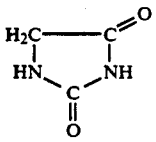
SD-1
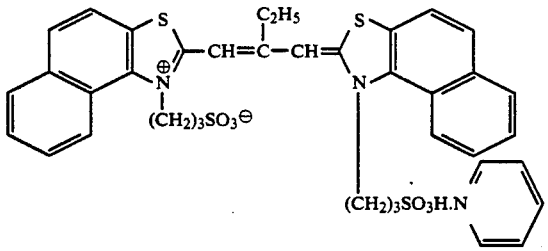
SD-2
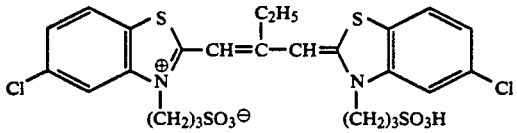
SD-3
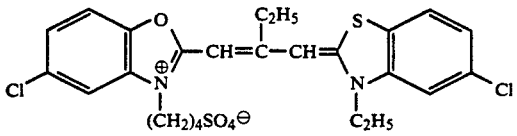

-continued
SD-4
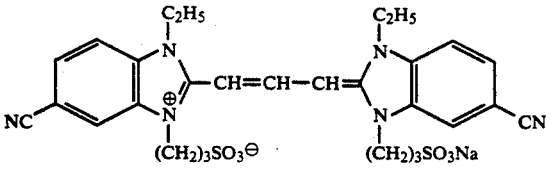
SD-5
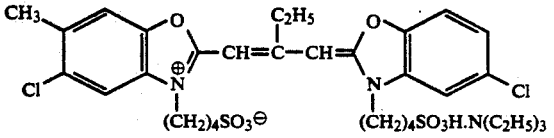
SD-6
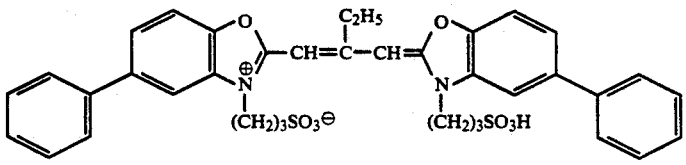
SD-7
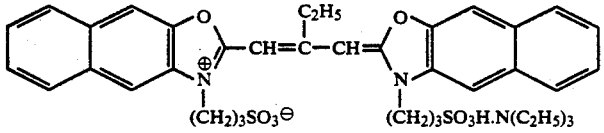
SD-8
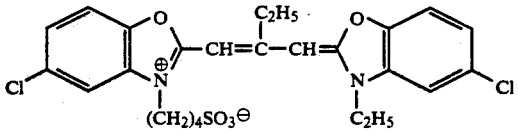
SD-9
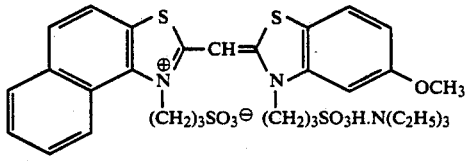
SD-10
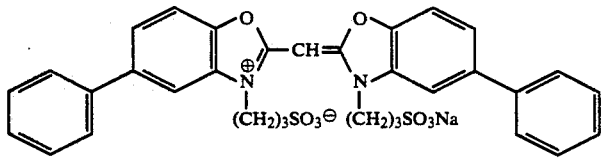
H-1
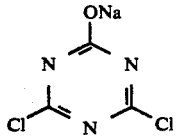
$(CH_2{=}CHSO_2CH_2)_2O$ H-2
ST-1
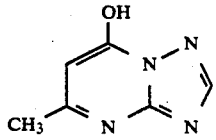

-continued

AF-1

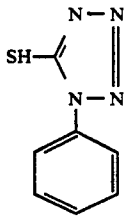

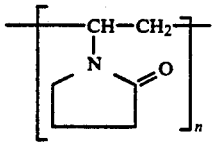

n: Degree of polymerization

Next, film sample Nos. 2 through 8 were prepared using 2-equivalent couplers for the present invention as shown in Table 1.

TABLE 1

| Sample No. | Layer 3 Coupler | Layer 3 Amount added* | Layer 4 Coupler | Layer 4 Amount added* | Layer 5 Coupler | Layer 5 Amount added* | Layer 7 Coupler | Layer 7 Amount added* | Layer 8 Coupler | Layer 8 Amount added* |
|---|---|---|---|---|---|---|---|---|---|---|
| (2) | C-24 | 5.66 | C-24 | 2.27 | C-8 | 1.93 | M-3 | 5.16 | M-3 | 0.71 |
| (3) | CCp-1 | 11.32 | CCp-1 | 4.53 | CCp-1/ C-8 | 1.81/ 1.52 | M-3 | 5.16 | M-3 | 0.71 |
| (4) | CCp-1 | 11.32 | CCp-1 | 4.53 | CCp-1/ C-8 | 1.81/ 1.52 | M-18 | 5.16 | M-18 | 0.71 |
| (5) | CCp-1 | 11.32 | CCp-1 | 4.53 | CCp-1/ C-8 | 1.81/ 1.52 | M-23 | 5.16 | M-23 | 0.71 |
| (6) | CCp-1 | 11.32 | CCp-1 | 4.53 | CCp-1/ C-8 | 1.81/ 1.52 | M-18 | 5.16 | M-18 | 0.71 |
| (7) | CCp-1 | 11.32 | CCp-1 | 4.53 | CCp-1/ C-8 | 1.81/ 1.52 | M-18 | 5.16 | M-18/ MCp-3 | 0.65/ 0.06 |
| (8) | CCp-1 | 11.32 | CCp-1 | 4.53 | CCp-1/ C-8 | 1.81/ 1.52 | M-18/ MCp-3 | 4.75/ 0.41 | M-18 | 0.71 |

| Sample No. | Layer 9 Coupler | Layer 9 Amount added* | Layer 11 Coupler | Layer 11 Amount added* | Layer 12 Coupler | Layer 12 Amount added* | Remarks |
|---|---|---|---|---|---|---|---|
| (2) | M-3 | 0.90 | Y-2 | 11.2 | Y-5 | 2.51 | Inventive |
| (3) | M-3 | 0.90 | Y-2/ Y-5 | 7.75/ 3.44 | Y-2/ Y-5 | 1.80/ 0.71 | Inventive |
| (4) | M-3 | 0.90 | Y-2/ Y-5 | 7.75/ 3.44 | Y-2/ Y-5 | 1.80/ 0.71 | Inventive |
| (5) | M-18 | 0.90 | Y-2/ Y-5 | 7.75 3.44 | Y-2/ Y-5 | 1.80/ 0.71 | Inventive |
| (6) | M-18/ MCp-3 | 0.83/ 0.07 | Y-2/ Y-5 | 7.75/ 3.44 | Y-2/ Y-5 | 1.80/ 0.71 | Inventive |
| (7) | M-18 | 0.90 | Y-2/ Y-5 | 7.75/ 3.44 | Y-2/ Y-5 | 1.80/ 0.71 | Inventive |
| (8) | M-18 | 0.90 | Y-2/ Y-5 | 7.75 3.44 | Y-2/ Y-5 | 1.80/ 0.71 | Inventive |

*Expressed in $10^{-4}$ mol/$m^2$

After the light-sensitive material samples thus prepared were subjected to exposure through an optical wedge, a running processing was conducted under the following conditions 1.

| Procedure | Processing time | Processing temperature | Amount of replenisher |
|---|---|---|---|
| Color development | 3 minutes 15 seconds | 38° C. | 775 ml |
| Bleaching | 45 seconds | 38° C. | 155 ml |
| Fixation | 1 minute 30 seconds | 38° C. | 400 ml |
| Stabilization | 50 seconds | 38° C. | 270 ml |

-continued

| Procedure | Processing time | Processing temperature | Amount of replenisher |
|---|---|---|---|
| Drying | 1 minute | 40–70° C. | — |

Note:
Figures for the amount of replenisher are per $m^2$ of light-sensitive material.

Stabilization was conducted by the counter current method using four baths, in which the replenisher was supplied to the final stabilizing bath and the overflow therefrom was allowed to enter in the previous bath so that the entire overflow from the first stabilizing bath flew in the fixing bath.

The processing solutions used in the above procedures had the following compositions:

| Color developer | |
|---|---|
| Potassium carbonate | 30.0 g |
| Sodium hydrogen carbonate | 2.5 g |
| Potassium sulfite | 3.0 g |
| Sodium bromide | 1.2 g |
| Potassium iodide | 0.6 mg |
| Hydroxylamine sulfate | 2.5 g |
| Sodium chloride | 0.6 g |
| 4-amino-3-methyl-N-ethyl-N-(β-hydroxylethyl)-aniline sulfate | 4.6 g |
| Diethylenetriaminepentaacetic acid | 3.0 g |
| Potassium hydroxide | 1.2 g |

Water was added to make a total quantity of 1 l, and potassium hydroxide or 20% sulfuric acid was added to obtain a pH of 10.01.

| Color developer replenisher | |
|---|---|
| Potassium carbonate | 40.0 g |
| Sodium hydrogen carbonate | 3.0 g |
| Potassium sulfite | 7.0 g |
| Sodium bromide | 0.5 g |
| Hydroxylamine sulfate | 3.1 g |
| 4-amino-3-methyl-N-ethyl-N-(β-hydroxylethyl)-aniline sulfate | 6.0 g |
| Diethylenetriaminepentaacetic acid | 3.0 g |
| Potassium hydroxide | 2.0 g |

Water was added to make a total quantity of 1 l, and potassium hydroxide or 20% sulfuric acid was added to obtain a pH of 10.12.

| Bleacher | |
|---|---|
| Ferric ammonium 1,3-propylenediaminetetra-acetate | 0.32 mol |
| Disodium ethylenediaminetetraacetate | 10 g |
| Ammonium bromide | 100 g |
| Glacial acetic acid | 40 g |
| Ammonium nitrate | 40 g |

Water was added to make a total quantity of 1 l, and aqueous ammonia or glacial acetic acid was added to obtain a pH of 4.4.

| Bleacher replenisher | |
|---|---|
| Ferric ammonium 1,3-propylenediaminetetra-acetate | 0.35 mol |
| Disodium ethylenediaminetetraacetate | 2 g |
| Ammonium bromide | 120 g |
| Ammonium nitrate | 50 g |
| Glacial acetic acid | 40 g |

Water was added to make a total quantity of 1 l, and aqueous ammonia or glacial acetic acid was added to obtain a pH of 3.4.

| Fixer and fixer replenisher | |
|---|---|
| Ammonium thiocyanate | 120 g |
| Ammonium thiosulfate | 200 g |
| Anhydrous sodium bisulfite | 20 g |
| Sodium metabisulfite | 4.0 g |
| Disodium ethylenediaminetetraacetate | 1.0 g |

Water was added to make a total quantity of 1 l, and glacial acetic acid and aqueous ammonia were added to obtain a pH of 6.5.

| Stabilizer and stabilizer replenisher | |
|---|---|
| Surfactant (listed in Table 2) | See Table 2 |
| *Dearcide* 702 (*Dearborn*) | 1.0 ml |
| Formaldehyde | See Table 2 |

Water was added to make a total quantity of 1 l, and potassium hydroxide or 20% sulfuric acid were added to obtain a pH of 8.5. Running processing was carried out using a compact developing machine until the amount of the stabilizer replenisher supplied reached two times the stabilizing bath tank capacity.

After completion of running processing, each stabilizing bath was examined for the occurrence of sulfides and occurrence of deposits on the inside wall thereof. Also, the magenta density in minimum density portion (Dmin(G)) and reticulation were examined in the film sample after processing. The results are shown in Table 2.

The evaluation criteria used are as follows.

1) Occurrence of sulfides in fixer

A: No occurrence.

B: Suspended matter noted on and in the fixer, but no problem.

C: Sulfides noted on and in the fixer, may pose a practical problem.

D: Precipitation and solid deposition in rack liquid interface.

The more the number of D marks, the more precipitation and solid deposition.

2) Reticulation

A: No occurrence.

B: Reticulation noted in several sites per roll of 24-shot film, but absolutely no problem.

C: More frequent reticulation than B, but no problem.

D: Still more frequent reticulation, posing a problem.

The more the number of D marks, the more frequently reticulation occurs.

TABLE 2

| Experiment No. | Film sample No. | Stabilizer surfactant (amount added) | Stabilizer formaldehyde (amount added) | $\Delta D_{min}(G)$* | Reticulation | Sulfides in fixer | Remarks |
|---|---|---|---|---|---|---|---|
| 1-1 | (1) | (II-3) (0.3 g/l) | 0.00 | 0.00 (reference value) | C | B | Comparative |
| 1-2 | (2) | (II-3) (0.3 g/l) | 0.00 | −0.02 | B | B | Inventive |
| 1-3 | (3) | (II-3) (0.3 g/l) | 0.00 | −0.02 | B | B | Inventive |
| 1-4 | (4) | (II-3) (0.3 g/l) | 0.00 | −0.02 | B | B | Inventive |
| 1-5 | (5) | (II-3) (0.3 g/l) | 0.00 | −0.02 | B | B | Inventive |
| 1-6 | (6) | (II-3) (0.3 g/l) | 0.00 | −0.02 | B | B | Inventive |
| 1-7 | (7) | (II-3) (0.3 g/l) | 0.00 | −0.02 | B | B | Inventive |
| 1-8 | (8) | (II-3) (0.3 g/l) | 0.00 | −0.02 | B | B | Inventive |
| 1-9 | (2) | Not added | 0.00 | +0.02 | C-D | C | Comparative |
| 1-10 | (2) | Ethylene glycol (3.0 g/l) | 0.00 | +0.01 | C | B-C | Comparative |

TABLE 2-continued

| Experiment No. | Film sample No. | Stabilizer surfactant (amount added) | Stabilizer formaldehyde (amount added) | $\Delta D_{min}(G)$* | Reticulation | Sulfides in fixer | Remarks |
|---|---|---|---|---|---|---|---|
| 1-11 | (2) | Diethylene glycol (3.0 g/l) | 0.00 | ±0.00 | C | B-C | Comparative |
| 1-12 | (2) | TEAC (1.0 g/l) | 0.00 | +0.01 | C | B-C | Comparative |
| 1-13 | (2) | DTMAC (1.0 g/l) | 0.00 | ±0.00 | C | B-C | Comparative |
| 1-14 | (2) | LMTS (1.0 g/l) | 0.00 | +0.01 | C | B-C | Comparative |
| 1-15 | (2) | DBSS (1.0 g/l) | 0.00 | −0.01 | C | B-C | Comparative |
| 1-16 | (2) | (I-1) (3.0 g/l) | 0.00 | −0.02 | B | B | Inventive |
| 1-17 | (2) | (I-5) (3.0 g/l) | 0.00 | −0.02 | B | B | Inventive |
| 1-18 | (2) | (I-6) (3.0 g/l) | 0.00 | −0.01 | B | B | Inventive |
| 1-19 | (2) | (I-12) (3.0 g/l) | 0.00 | −0.02 | B | B | Inventive |
| 1-20 | (2) | (II-14) (0.3 g/l) | 0.00 | −0.02 | B | B | Inventive |
| 1-21 | (2) | (II-4) (0.3 g/l) | 0.00 | −0.02 | B | B | Inventive |
| 1-22 | (2) | (II-8) (0.3 g/l) | 0.00 | −0.02 | B | B | Inventive |
| 1-23 | (2) | (II-12) (0.3 g/l) | 0.00 | −0.01 | B | B | Inventive |
| 1-24 | (2) | (II-15) (0.3 g/l) | 0.00 | −0.02 | B | B | Inventive |
| 1-25 | (2) | (II-16) (0.3 g/l) | 0.00 | −0.02 | B | B | Inventive |
| 1-26 | (2) | (II-3) (0.3 g/l) | 0.60 | −0.02 | A | DD | Comparative |
| 1-27 | (2) | (II-3) (0.3 g/l) | 0.30 | −0.02 | B | D | Comparative |
| 1-28 | (2) | (II-3) (0.3 g/l) | 0.20 | −0.02 | B | B | Inventive |
| 1-29 | (2) | (II-3) (0.3 g/l) | 0.10 | −0.02 | B | B | Inventive |

Note:
TEAC denotes triethylammonium chloride;
DTMAC denotes dodecyltrimethylammonium chloride;
LMTS denotes sodium lauroylmethyltaurate;
DBSS denotes sodium dodecylbenzenesulfonate.
*$\Delta D_{min}(G) = D_{min}(G) - D_{min}(G)$ reference
$D_{min}(G)$ reference is the minimum magenta density of sample No. 1-1.

It is evident from Table 2 that when the entire overflow from stabilizer was allowed to enter in the fixing bath, the samples according to the present invention were generally better than the comparative samples with respect to magenta density at minimum density portion, reticulation and occurrence of sulfides in the fixing bath.

Treated samples from Experiment Nos. 1-1 through 1-8 were stored at a temperature of 80° C. and a relative humidity of 75% for 10 days and tested for maximum magenta density and dye fading rate. The light-sensitive material samples according to the present invention proved better than the comparative sample No. 1 even when the stabilizer contained substantially no formaldehyde. Also found was that the films processed with a surfactant according to the invention has no back face stain or uneven wetting.

Example 2

The light-sensitive material sample used in Example 1 was subjected to continuous processing under the following conditions 2.

| Procedure | Processing time | Processing temperature | Amount of replenisher |
|---|---|---|---|
| Color development | 3 minutes 15 seconds | 38 ± 0.3° C. | 536 ml |
| Bleach-fixation | 4 minutes 15 seconds | 38 ± 2.0° C. | 730 ml |
| Stabilization | 1 minute | 38 ± 5.0° C. | 270 ml |
| Drying | 1 minute | 55 ± 5.0° C. | — |

Note:
Figures for the amount of replenisher are per $m^2$ of light-sensitive material.

The color developer, bleach-fixer, stabilizer and replenishers used are shown below. Stabilization was conducted by the counter current method using four baths, in which the replenisher was supplied to the final bath.

Color developer and replenisher

-continued

| | |
|---|---|
| The same as used in Example 1. | |
| Bleach-fixer | |
| Water | 800 ml |
| Ferric ammonium ethylenediaminetetraacetate | 80 g |
| Ferric ammonium diethylenetriaminepentaacetate | 100 g |
| Ethylenediaminetetraacetic acid | 2 g |
| Ammonium sulfite | 20 g |
| Ammonium thiosulfate | 150 g |
| Ammonium thiocyanate | 120 g |
| Aqueous ammonia (25%) | 12 ml |

After adjusting to a pH of 6.5 with aqueous ammonia or acetic acid, water was added to make a total quantity of 1 l.

| Bleach-fixer replenisher | |
|---|---|
| Water | 700 ml |
| Ferric ammonium ethylenediaminetetraacetate | 130 g |
| Ferric ammonium diethylenetriaminepentaacetate | 150 g |
| Ethylenediaminetetraacetic acid | 2 g |
| Ammonium sulfite | 30 g |
| Ammonium thiosulfate | 180 g |
| Ammonium thiocyanate | 150 g |
| Aqueous ammonia (25%) | 15 ml |

After adjusting to a pH of 6.0 with aqueous ammonia or acetic acid, water was added to make a total quantity of 1 l.

Stabilizer and stabilizer replenisher

The same as used in Example 1.

Before proceeding to continuous processing, the bleaching bath and fixing bath of the automatic developing machine used in Example 1 were combined to a single bath for bleach-fixation. The other conditions of continuous processing and experimental conditions were the same as in Example 1, followed by evaluation in the same manner as in Example 1. The results obtained were similar to those obtained in Example 1.

Example 3

After the film sample No. 2 prepared in Example 1 was subjected to imagewise exposure, a running processing was conducted under the following conditions 3 in various amounts of stabilizer replenisher added.

| Procedure | Processing time | Processing temperature | Amount of replenisher |
|---|---|---|---|
| Color development | 3 minutes 15 seconds | 38° C. | 775 ml |
| Bleaching | 45 seconds | 38° C. | 155 ml |
| Fixation | 1 minute 30 seconds | 38° C. | 400 ml |
| Stabilization | 50 seconds | 38° C. | See Table 3 |
| Drying | 1 minute | 40–70° C. | — |

Note: Figures for the amount of replenisher are per $m^2$ of light-sensitive material.

Stabilization was conducted by the counter current method using four baths, in which the replenisher was supplied to the final stabilizing bath and the overflow therefrom was allowed to enter in the preceding bath so that the entire overflow from the first stabilizing bath flew in the fixing bath.

The processing solutions and replenishers used were the same as in Example 1.

TABLE 3

| Experiment No. | Film sample No. | Stabilizer surfactant (amount added) | Amount of stabilizer formaldehyde (amount added) | replenisher ($ml/m^2$) | $\Delta D_{min}(G)$* | Reticulation | Sulfides in fixer | Remarks |
|---|---|---|---|---|---|---|---|---|
| 3-1 | (2) | (II-3) (0.3 g/l) | 0.00 | 700 | ±0.00 | B | B | Inventive |
| 3-2 | (2) | (II-3) (0.3 g/l) | 0.00 | 670 | ±0.00 | B | B | Inventive |
| 3-3 | (2) | (II-3) (0.3 g/l) | 0.00 | 500 | ±0.00 | B | B | Inventive |
| 3-4 | (2) | (II-3) (0.3 g/l) | 0.00 | 270 | +0.01 | B | B | Inventive |
| 3-5 | (2) | Not added | 0.00 | 700 | 0.00 (reference value) | B | B | Comparative |
| 3-6 | (2) | Not added | 0.00 | 670 | +0.02 | C | B–C | Comparative |
| 3-7 | (2) | Not added | 0.00 | 500 | +0.03 | C | C | Comparative |
| 3-8 | (2) | Not added | 0.00 | 270 | +0.05 | C–D | C | Comparative |

*$\Delta D_{min}(G) = D_{min}(G) - D_{min}(G)$ reference
$D_{min}(G)$ reference is the value for sample No. 3-5.

Evaluation was made in the same manner as in Example 1. The results are given in Table 3.

It is evident from Table 3 that the effect of the invention of suppressing increase in minimum magenta density is enhanced when the amount of replenisher is not more than 670 $ml/m^2$.

Example 4

The film samples listed in Table 4 were prepared in the same manner as with the film sample No. 2 prepared in Example 1 except that the total amount of silver coated was varied.

TABLE 4

| Film sample No. | Total amount of silver coated |
|---|---|
| 9 | 1.0 |
| 10 | 2.0 |
| 11 | 3.0 |
| 12 | 4.0 |
| 13 | 8.0 |
| 14 | 10.0 |
| 15 | 11.0 |

The film samples thus prepared were processed in the same manner as in Experiment No. 1-2 in Example 1 and evaluated in the same manner as in Example 1. Also, maximum cyan dye density and fixability were determined. The results are summarized in Table 5.

TABLE 5

| Experiment No. | Film sample No. | $\Delta D_{max}(R)$ | Stability (residual silver) ($mg/100\ cm^2$) | Reticulation | Occurrence of sulfides in fixer |
|---|---|---|---|---|---|
| 5-1 | 2 | 0.00 (reference value) | 0.1 | B | B |
| 5-2 | 9 | −0.49 | 0.1 | B | B |
| 5-3 | 10 | −0.29 | 0.0 | B | B |
| 5-4 | 11 | −0.11 | 0.0 | B | B |
| 5-5 | 12 | −0.03 | 0.0 | B | B |
| 5-6 | 13 | ±0.00 | 0.1 | B | B |
| 5-7 | 14 | ±0.00 | 2.0 | C–B | C–B |
| 5-8 | 15 | ±0.00 | 4.0 | C | C |

*$\Delta D_{max}(R) = D_{max}(R) - D_{max}(R)$ reference

As is evident from Table 5, for enhancing the effect of the invention without being accompanied by degradation of photographic performance, the amount of silver contained in film sample is preferably not less than 2 $g/m^2$ and not more than 10 $g/m^2$, more preferably 4 to 8 $g/m^2$.

Example 5

To the film sample No. 2 prepared in Example 1 was added a compound listed in Table 6 to 10 $mg/m^2$ and tested in the same manner as in Experiment No. 1-2 in Example 1. The results are summarized in Table 6.

TABLE 6

| Experiment No. | Compound added | $\Delta D_{min}(G)$ | Reticulation | Occurrence of sulfides in fixer |
|---|---|---|---|---|
| 6-1 | Not added | −0.02 | B | B |
| 6-2 | Phenol | −0.02 | B | B |
| 6-3 | Dehydroacetic acid | −0.03 | C–B | B |
| 6-4 | Thiazolyl-benzimidazole | −0.02 | B | B |
| 6-5 | Chlorodiphenyl | −0.01 | B | B |
| 6-6 | Cresol | −0.03 | B | B |
| 6-7 | p-amino-benzene-sulfamide | −0.02 | B | B |
| 6-8 | B-1-1 | +0.00 | A | B–A |
| 6-9 | B-1-16 | +0.00 | A | B–A |
| 6-10 | B-1-18 | +0.01 | A | B–A |
| 6-11 | B-2-1 | +0.02 | A | B–A |
| 6-12 | B-2-2 | +0.00 | A | B–A |
| 6-13 | B-2-7 | +0.00 | A | B–A |
| 6-14 | B-2-10 | +0.01 | A | B–A |
| 6-15 | B-3-1 | +0.01 | A | B–A |
| 6-16 | B-3-6 | +0.00 | A | B–A |

As seen in Table 6, the effect of the invention is enhanced when a compound represented by one of Formulas B-1 through B-3 is used in combination with the light-sensitive material for the processing method of the invention.

The present invention provides a processing method for silver halide color photographic light-sensitive material which offers good dye image preservability and improved staining in the unexposed portion and which permits waste liquid reduction and is hence excellent from the socioenvironmental viewpoint.

What is claimed is:

1. A processing method for a silver halide color photographic light-sensitive material comprising (a) processing said material with a fixing solution, (b) processing said material with a stabilizing solution having a pH of 7.5 to 10, and then about 270 ml to about 800 ml of the overflow from the said stabilizing solution are allowed to enter into said fixing solution and said stabilizer contains substantially no formaldehyde but contains a compound represented by Formula I or Formula II, wherein said silver halide color photographic light-sensitive material comprising:

(I) a coupler represented by Formula 2eq-1, (II) the total amount of silver coated in said silver halide color photographic light sensitive material is not less than 2 g per $m^2$ of said light-sensitive material; and (III) a compound represented by Formula B-3;

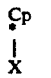

Formula 2eq-1 wherein Cp represents a coupler residue; * represents a coupler coupling site; X represents a group which splits off upon dye formation by coupling with the oxidation product of an aromatic primary amine based color developing agent;

$R_1—O—(R_2—O)_m—X_1$ Formula I wherein $R_1$ represents a monovalent organic group, $R_2$ represents an ethylene group, a trimethylene group or a propylene group, m represents an integer of 4 to 50, $X_1$ represents a hydrogen atom, $—SO_3M$ or $—PO_3M_2$, wherein M represents a hydrogen atom, an alkali metal or an ammonium group:

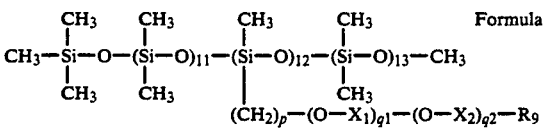

Formula II wherein $R_9$ represents a hydrogen atom, a hydroxyl group, a lower alkyl group, an alkoxyl group, or

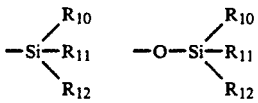

$R_{10}$, $R_{11}$, and $R_{12}$ independently represent a hydrogen atom or a lower alkyl group, whether identical or not; 11 through 13 independently represent an integer of 0 to 30; p, $q^1$ and $q^2$ independently represent an integer of 0 to 30;

$X_1$ and $X_2$ independently represent $—CH_2CH_2—$, $—CH_2CH_2CH_2—$,

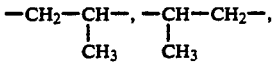

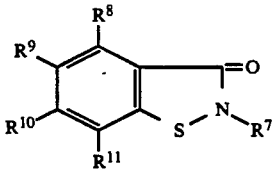

Formula B-3 wherein $R_7$ represents a hydrogen atom, a halogen atom, an alkyl group, an aryl group, a halogenated alkyl group, an arylalkyl group, $—R^{15}—OR^{16}$, $—CONHR^{17}$, (where $R^{15}$ represents an alkylene group, $R_{16}$ and $R_{17}$ each represent a hydrogen atom, or an alkyl group; and $R_8$, $R_9$, $R_{10}$ and $R_{11}$ each represent a hydrogen atom, a halogen atom, a hydroxyl group, an alkyl group, an amino group, or a nitro group.

2. The processing method for silver halide color photographic light-sensitive material of claim 1 wherein the total amount of silver coated in said silver halide color photographic light-sensitive material is not less than 2 g per $m^2$ of light-sensitive material.

3. The processing method for silver halide color photographic light-sensitive material of claim 2 wherein said silver halide color photographic light-sensitive material contains a compound represented by the following formulae B-1 through B-3,

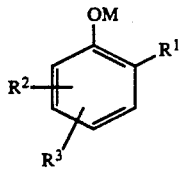

Formula B-1 wherein $R_1$ represents an alkyl group, a cycloalkyl group, an aryl group, a hydroxy group, an alkoxycarbonyl group, an amino group, a carboxylic acid group (including its salt) or a sulfonic acid group (including its salt); $R^2$ and $R^3$ independently represent a hydrogen atom, a halogen atom, an amino group, a nitro group, a hydroxy group, an alkoxycarbonyl group, a carboxylic acid group (including its salt) or a sulfonic acid group (including its salt), M represents a hydrogen atom, an alkali metal or an ammonium group;

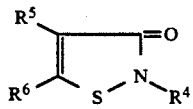

Formula B-2

-continued

Formula B-3

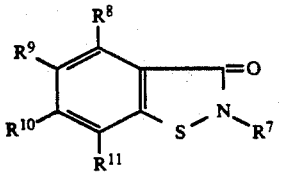

wherein $R^4$ represents a halogen atom, an alkyl group, an aryl group, a halogenated an alkyl group, $—R^{12}$, $—OR^{13}$, $CONHR^{14}$ ($R^{12}$ represents a hydrogen atom, an alkyl group or an arylalkyl group) or an arylalkyl group; $R^5$ and $R^6$ independently represent a hydrogen atom, a halogen atom, halogenated alkyl group or alkyl group; $R^8$, $R^9$, $R^{10}$, and $R^{11}$ independently represent hydrogen, halogen, hydroxyl, alkyl, amino or nitro.

* * * * *